US010479124B2

(12) United States Patent
Moriguchi et al.

(10) Patent No.: US 10,479,124 B2
(45) Date of Patent: Nov. 19, 2019

(54) INKJET PRINTING APPARATUS AND TEMPERATURE CONTROL METHOD THEREOF

(71) Applicant: CANON KABUSHIKI KAISHA, Tokyo (JP)

(72) Inventors: Takuto Moriguchi, Kamakura (JP); Yusuke Nakaya, Inagi (JP); Ryosuke Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/025,548

(22) Filed: Jul. 2, 2018

(65) Prior Publication Data

US 2019/0009600 A1 Jan. 10, 2019

(30) Foreign Application Priority Data

Jul. 6, 2017 (JP) ..... 2017-133058

(51) Int. Cl.

| | |
|---|---|
| ***B41M 5/00*** | (2006.01) |
| ***B41J 2/005*** | (2006.01) |
| ***B41J 2/045*** | (2006.01) |
| ***B41J 2/14*** | (2006.01) |
| ***B41J 2/175*** | (2006.01) |
| ***B41J 2/18*** | (2006.01) |

(52) U.S. Cl.

CPC ..... *B41M 5/0011* (2013.01); *B41J 2/0057* (2013.01); *B41J 2/0458* (2013.01); *B41J 2/04528* (2013.01); *B41J 2/04563* (2013.01); *B41J 2/04566* (2013.01); *B41J 2/1404* (2013.01); *B41J 2/175* (2013.01); *B41J 2/18* (2013.01); *B41J 2202/12* (2013.01)

(58) Field of Classification Search

CPC .. B41J 2/0057; B41J 2/04528; B41J 2/04563; B41J 2/0458; B41J 2/1404; B41J 2/175; B41J 2/18; B41M 5/0011

See application file for complete search history.

(56) References Cited

U.S. PATENT DOCUMENTS

| | | | | |
|---|---|---|---|---|
| 6,682,189 | B2 | 1/2004 | May et al. | |
| 6,767,092 | B2 | 7/2004 | May et al. | |
| 7,682,760 | B2 * | 3/2010 | Okuno | G03F 1/30 430/5 |
| 7,832,852 | B2 * | 11/2010 | Leighton | B41J 11/002 347/102 |

(Continued)

FOREIGN PATENT DOCUMENTS

| | | | |
|---|---|---|---|
| JP | H05-147209 | A | 6/1993 |
| JP | 2003-182064 | A | 7/2003 |

*Primary Examiner* — Lamson D Nguyen
(74) *Attorney, Agent, or Firm* — Venable LLP

(57) ABSTRACT

According to an embodiment of the present invention, an inkjet printing apparatus capable of controlling temperatures of a transfer member and a printhead properly, and printing a high-quality image is provided. More specifically, in an inkjet printing apparatus that includes a transfer member, a printhead configured to discharge ink to form an image on the transfer member, and a transfer unit configured to transfer the image on the transfer member to a print medium, the following control is performed. That is, the transfer member is heated, a temperature of the heated transfer member is measured, and a temperature of the printhead is adjusted based on the measured temperature.

18 Claims, 21 Drawing Sheets

(56) References Cited

U.S. PATENT DOCUMENTS

| | | | | |
|---|---|---|---|---|
| 8,205,957 | B2 * | 6/2012 | Ito | B41J 2/0456 347/14 |
| 8,764,156 | B1 * | 7/2014 | Ramesh | B41J 2/14153 347/17 |
| 9,116,464 | B2 * | 8/2015 | Komatsu | G03G 15/0893 |
| 9,527,314 | B2 | 12/2016 | Moriguchi et al. | |
| 2018/0250930 | A1 | 9/2018 | Sato et al. | |
| 2018/0250967 | A1 | 9/2018 | Sato et al. | |
| 2019/0009592 | A1 | 1/2019 | Okushima et al. | |
| 2019/0016112 | A1 | 1/2019 | Tsushima et al. | |

* cited by examiner

SURFACE TEMPERATURE OF TRANSFER MEMBER AT TIME OF 1 ROUND OF DRUM

FIG. 16A
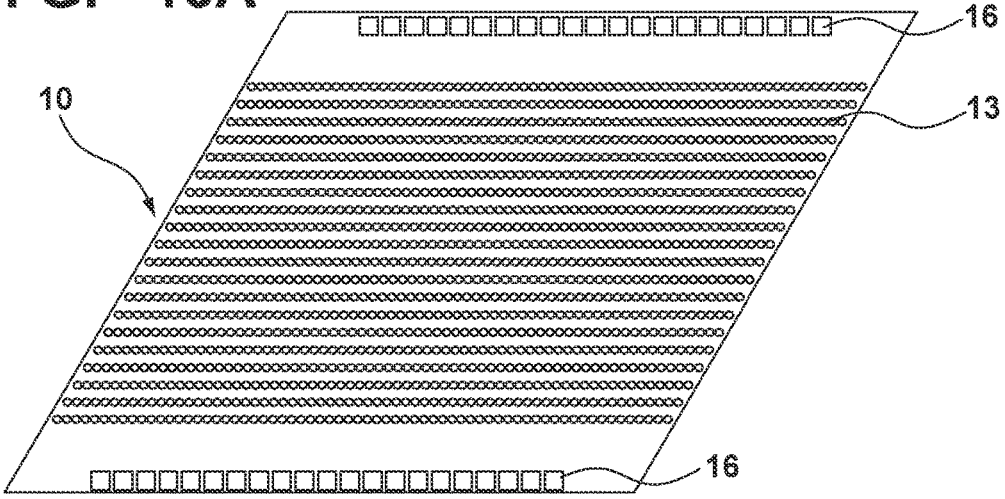
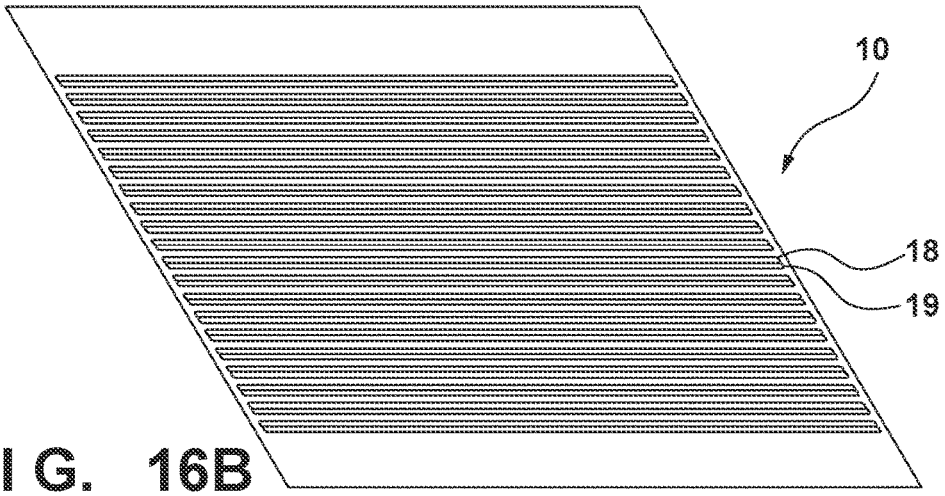
FIG. 16B
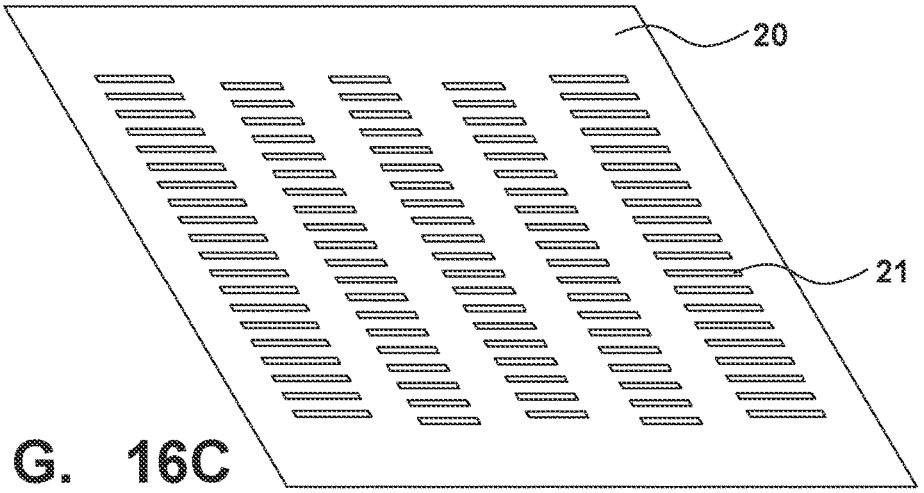
FIG. 16C

INKJET PRINTING APPARATUS AND TEMPERATURE CONTROL METHOD THEREOF

BACKGROUND OF THE INVENTION

Field of the Invention

The present invention relates to an inkjet printing apparatus and a temperature control method thereof, and particularly to, for example, an inkjet printing apparatus that transfers an image formed by discharging ink to an intermediate transfer member to a print medium to print the image, and a temperature control method thereof.

Description of the Related Art

Conventionally, printing apparatuses that perform printing in accordance with an inkjet method include a printing apparatus configured to discharge ink to an intermediate drum by a printhead to form an image on the intermediate drum, and transfer the image to a print medium to print the image. For example, Japanese Patent Laid-Open No. 2003-182064 discloses an arrangement that includes an image forming unit using an inkjet printhead, an ink removal unit, a transfer processing unit, and the like around an intermediate transfer member (also simply referred to as a transfer member) such as an intermediate drum.

Japanese Patent Laid-Open No. 5-147209 also discloses an inkjet printing apparatus configured to form an image by discharging ink from a printhead to an intermediate transfer member and transfer the formed image from the intermediate transfer member to printing paper. According to Japanese Patent Laid-Open No. 5-147209, although high-temperature ink discharged from the printhead is cooled by a ring-shaped intermediate transfer member wound around a roller, the intermediate transfer member and the discharged ink are reheated by a heater, transferring liquid ink to the printing paper.

A printing apparatus that repeats a process of forming an image by discharging ink to an intermediate transfer member by an inkjet printhead and a process of transferring the formed image from the intermediate transfer member to a print medium includes a cooling unit which decreases the temperature of the intermediate transfer member and a heating unit which increases the temperature of the intermediate transfer member.

In the related art, however, a lack of a unit which controls the temperature of the intermediate transfer member leads to susceptibility to an external disturbance (an environment temperature, a drum temperature of the intermediate transfer member, ink latent heat, color unevenness, or the like), making it impossible to accurately maintain the temperature of the intermediate transfer member. Therefore, when a space between the printhead and the intermediate transfer member is set in a high-humid state by ink discharged from the printhead, dew condensation occurs in the printhead, and the quality of the formed image deteriorates due to a discharge failure or a falling dew drop.

SUMMARY OF THE INVENTION

Accordingly, the present invention is conceived as a response to the above-described disadvantages of the conventional art.

For example, an inkjet printing apparatus and a temperature control method thereof according to this invention are capable of controlling the temperature of a printhead properly and printing a high-quality image.

According to one aspect of the present invention, there is provided an inkjet printing apparatus comprising: a transfer member; a printhead configured to discharge ink to form an image on the transfer member; a transfer unit configured to transfer the image on the transfer member to a print medium; a heating unit configured to heat the transfer member; a first measurement unit configured to measure a temperature of the transfer member heated by the heating unit; and an adjustment unit configured to adjust a temperature of the printhead based on a temperature measured by the first measurement unit.

According to another aspect of the present invention, there is provided a temperature control method in an inkjet printing apparatus that includes a transfer member, a printhead configured to discharge ink to form an image on the transfer member, and a transfer unit configured to transfer the image on the transfer member to a print medium, comprising: heating the transfer member by a heater; measuring a temperature of the heated transfer member; and adjusting a temperature of the printhead based on the measured temperature.

The invention is particularly advantageous since it is possible to prevent dew condensation in a printhead by accurately controlling the temperature of the printhead.

Further features of the present invention will become apparent from the following description of exemplary embodiments (with reference to the attached drawings).

BRIEF DESCRIPTION OF THE DRAWINGS

FIGS. 16A, 16B and 16C are views each showing the structure of the element substrate;

DESCRIPTION OF THE EMBODIMENTS

Exemplary embodiments of the present invention will now be described in detail in accordance with the accompanying drawings. Note that arrows X and Y indicate the horizontal directions, respectively, the arrows X and Y are perpendicular to each other in each figure, and arrow Z indicates the vertical direction.

<Description of Terms>

In this specification, the terms "print" and "printing" not only include the formation of significant information, such as characters and graphics, but also broadly include the formation of images, figures, patterns, and the like, on a print medium, or the processing of the medium, regardless of whether they are significant or insignificant and whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium. Note that this invention is not limited to any specific ink component, however, it is assumed that this embodiment uses water-base ink including water, resin, and pigment serving as coloring material.

Further, a "print element (or nozzle)" generically means an ink orifice or a liquid channel communicating with it, and an element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Printing System>

Figure 1:
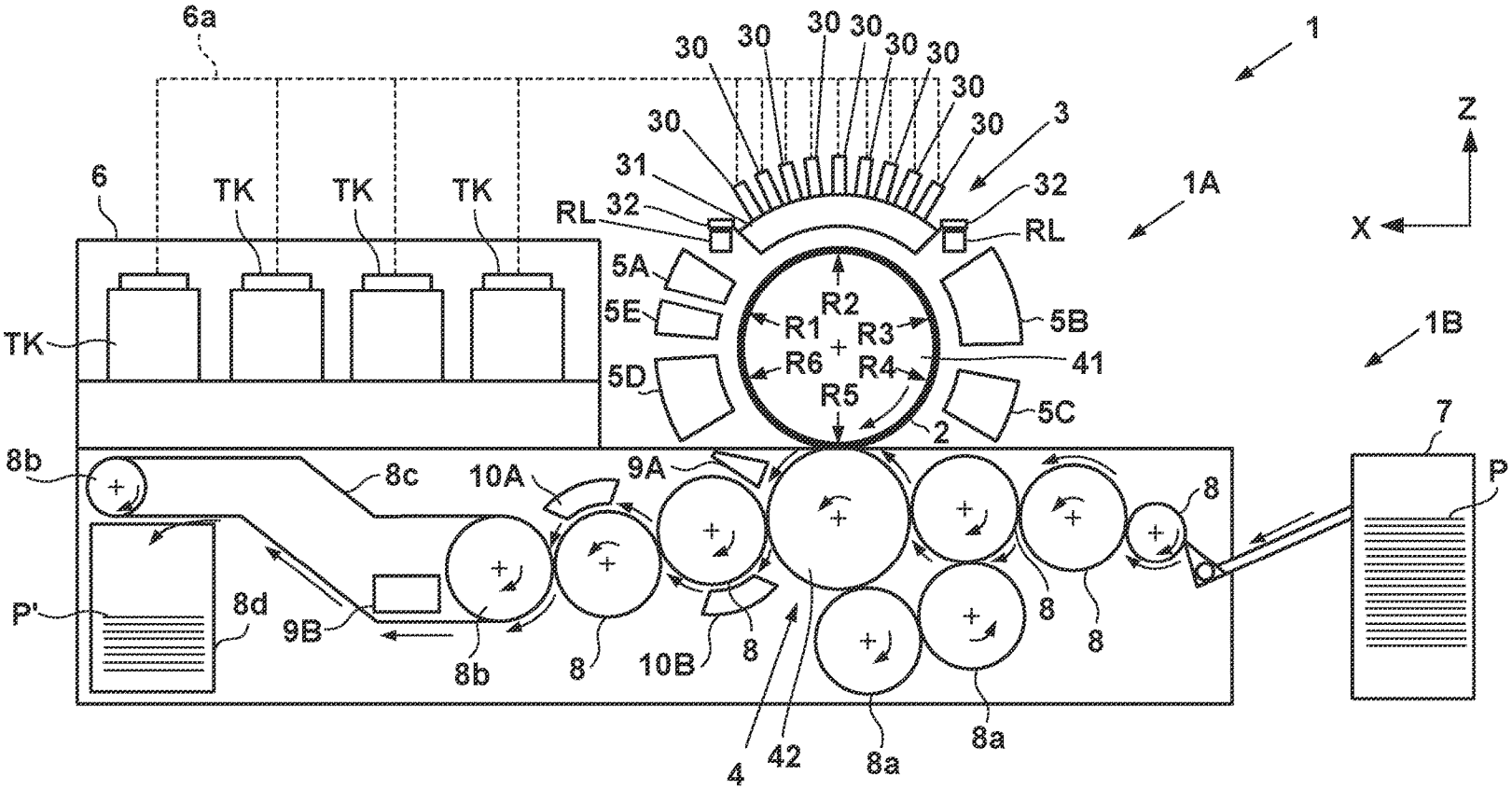
FIG. 1 is a schematic view showing a printing system according to an exemplary embodiment of the present invention.

FIG. 1 is a front view schematically showing a printing system 1 according to an embodiment of the present invention. The printing system 1 is a sheet inkjet printer that forms a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction.

<Printing Apparatus>

The printing apparatus 1A includes a print unit 3, a transfer unit 4, peripheral units 5A to 5E, and a supply unit 6.

<Print Unit>

Figure 2:
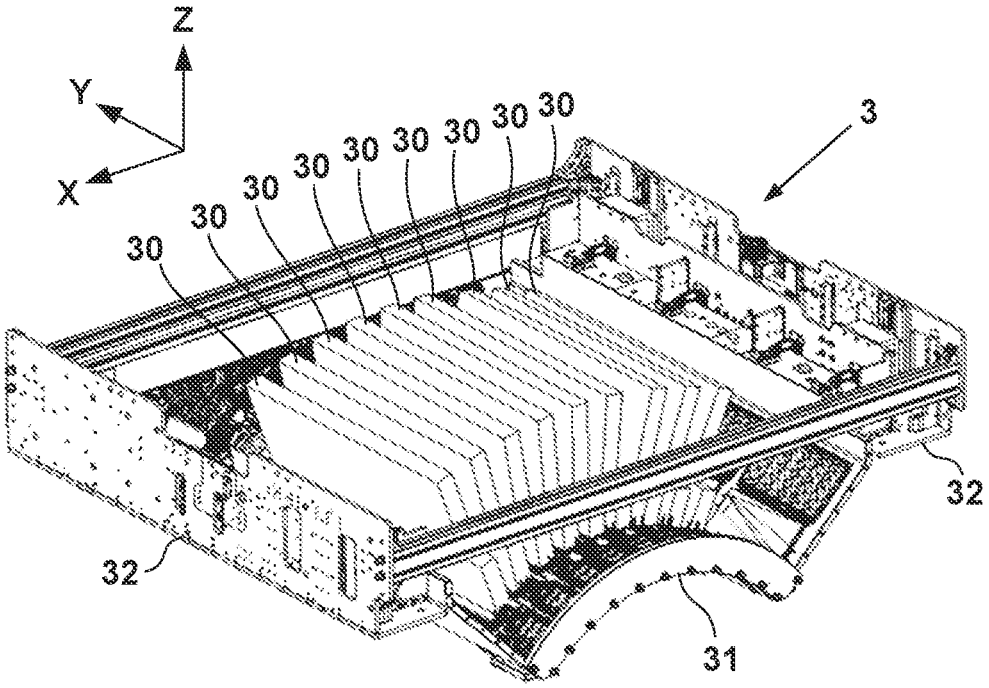
FIG. 2 is a perspective view showing a print unit.

The print unit 3 includes a plurality of printheads 30 and a carriage 31. A description will be made with reference to FIGS. 1 and 2. FIG. 2 is perspective view showing the print unit 3. The printheads 30 discharge liquid ink to the transfer member (intermediate transfer member) 2 and form ink images of a printed image on the transfer member 2.

In this embodiment, each printhead 30 is a full-line head elongated in the Y direction, and nozzles are arrayed in a range where they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move on a circular orbit cyclically, and thus the plurality of printheads 30 are arranged radially.

A detailed arrangement of the printhead 30 will be described later.

In this embodiment, nine (9) printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. However, one printhead 30 may be configured to discharge the plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide member RL. In this embodiment, the guide members RL are rail members elongated in the Y direction and provided as a pair separately in the X direction. A slide portion 32 is provided on each side of the carriage 31 in the X direction. The slide portions 32 engage with the guide members RL and slide along the guide members RL in the Y direction.

Figure 3:
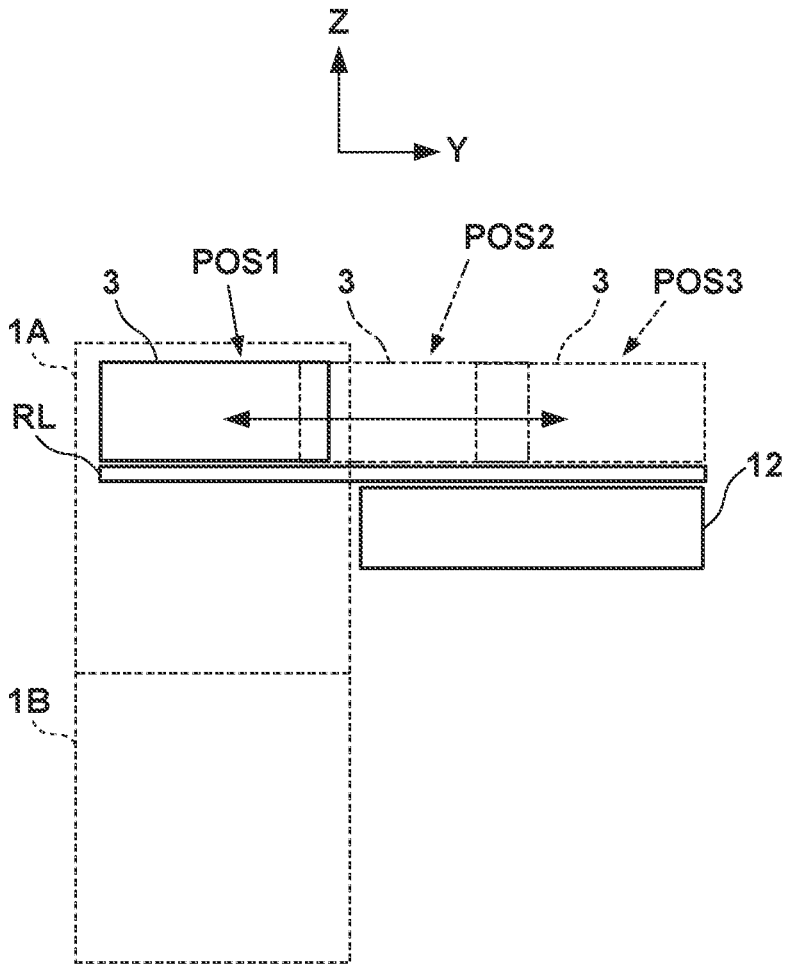
FIG. 3 is an explanatory view showing a displacement mode of the print unit in FIG. 2.

FIG. 3 is a view showing a displacement mode of the print unit 3 and schematically shows the right side surface of the printing system 1. A recovery unit 12 is provided in the rear of the printing system 1. The recovery unit 12 has a mechanism for recovering discharge performance of the printheads 30. For example, a cap mechanism which caps the ink discharge surface of each printhead 30, a wiper mechanism which wipes the ink discharge surface, a suction mechanism which sucks ink in the printhead 30 by a negative pressure from the ink discharge surface can be given as such mechanisms.

The guide member RL is elongated over the recovery unit 12 from the side of the transfer member 2. By the guide of the guide member RL, the print unit 3 is displaceable between a discharge position POS1 at which the print unit 3 is indicated by a solid line and a recovery position POS3 at which the print unit 3 is indicated by a broken line, and is moved by a driving mechanism (not shown).

The discharge position POS1 is a position at which the print unit 3 discharges ink to the transfer member 2 and a position at which the ink discharge surface of each printhead 30 faces the surface of the transfer member 2. The recovery position POS3 is a position retracted from the discharge position POS1 and a position at which the print unit 3 is positioned above the recovery unit 12. The recovery unit 12 can perform recovery processing on the printheads 30 when the print unit 3 is positioned at the recovery position POS3. In this embodiment, the recovery unit 12 can also perform the recovery processing in the middle of movement before the print unit 3 reaches the recovery position POS3. There is a preliminary recovery position POS2 between the discharge position POS1 and the recovery position POS3. The recovery unit 12 can perform preliminary recovery processing on the printheads 30 at the preliminary recovery position POS2 while the printheads 30 move from the discharge position POS1 to the recovery position POS3.

<Transfer Unit>

The transfer unit 4 will be described with reference to FIG. 1. The transfer unit 4 includes a transfer drum 41 and a pressurizing drum 42. Each of these drums is a rotating body that rotates about a rotation axis in the Y direction and has a columnar outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates counterclockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends divided into a plurality of segments. The respective segments can be arranged in an arc at an equal pitch on the outer peripheral surface of the transfer drum 41.

The transfer member 2 moves cyclically on the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area where preprocessing is performed on the transfer member 2 before the print unit 3 discharges ink and an area where the peripheral unit 5A performs processing. In this embodiment, a reactive liquid is applied. The discharge area R2 is a formation area where the print unit 3 forms an ink image by discharging ink to the transfer member 2. The processing areas R3 and R4 after discharge are processing areas where processing is performed on the ink image after ink discharge. The processing area R3 after discharge is an area where the peripheral unit 5B performs processing, and the processing area R4 after discharge is an area where the peripheral unit 5C performs processing. The transfer area R5 is an area where the transfer unit 4 transfers the ink image on the transfer member 2 to the print medium P. The processing area R6 after transfer is an area where post processing is performed on the transfer member 2 after transfer and an area where the peripheral unit 5D performs processing.

Note that a peripheral unit 5E is provided between the processing area R1 before discharge and the processing area R6 after transfer, and cooling of the transfer member 2 is performed by applying a cooling liquid and collecting it from the peripheral unit 5E.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer but may be an accumulative body of a plurality of layers. If the transfer member 2 is formed by the plurality of layers, it may include three layers of, for example, a surface layer, an elastic layer, and a compressed layer. The surface layer is an outermost layer having an image formation surface where the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials, such as a resin and a ceramic, can be used appropriately. With respect to durability, or the like, however, a material high in compressive modulus can be used. More specifically, an acrylic resin, an acrylic silicone resin, a fluoride-containing resin, a condensate obtained by condensing a hydrolyzable organosilicon compound, and the like, can be used. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like, can be used as the surface treatment. A plurality of these treatments may be combined. It is also possible to provide any desired surface shape in the surface layer.

For example, acrylonitrile-butadiene rubber, acrylic rubber, chloroprene rubber, urethane rubber, silicone rubber, or the like can be given as a material for the compressed layer. When such a rubber material is formed, a porous rubber material may be formed by blending a predetermined amount of a vulcanizing agent, vulcanizing accelerator, or the like and further blending a foaming agent, or a filling agent such as hollow fine particles or salt as needed. Consequently, a bubble portion is compressed along with a volume change with respect to various pressure fluctuations, and thus deformation in directions other than a compression direction is small, making it possible to obtain more stable transferability and durability. As the porous rubber material, there are a material having an open cell structure in which respective pores continue to each other and a material having a closed cell structure in which the respective pores are independent of each other. However, either structure may be used, or both of these structures may be used.

As a member for the elastic layer, the various materials, such as the resin and the ceramic, can be used appropriately. With respect to processing characteristics, various materials of an elastomer material and a rubber material can be used. More specifically, for example, fluorosilicone rubber, phenyl silicone rubber, fluorine rubber, chloroprene rubber, urethane rubber, nitrile rubber, and the like, can be used. In addition, ethylene propylene rubber, natural rubber, styrene rubber, isoprene rubber, butadiene rubber, the copolymer of ethylene/propylene/butadiene, nitrile-butadiene rubber, and the like, can be used. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer and between the elastic layer and the compressed layer, various adhesives or double-sided adhesive tapes can also be used in order to fix them to each other. The transfer member 2 may also include a reinforce layer high in compressive modulus in order to suppress elongation in a horizontal direction or maintain resilience when attached to the transfer drum 41. Woven fabric may be used as a reinforce layer. The transfer member 2 can be manufactured by combining the respective layers formed by the materials described above in any desired manner.

The outer peripheral surface of the pressurizing drum 42 is pressed against the transfer member 2. At least one grip mechanism which grips the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

The transfer drum 41 and the pressurizing drum 42 share a driving source such as a motor that drives them. A driving force can be delivered by a transmission mechanism such as a gear mechanism.

<Peripheral Unit>

The peripheral units 5A to 5E are arranged around the transfer drum 41. In this embodiment, the peripheral units 5A to 5E are specifically an application unit, an absorption unit, a heating unit, a cleaning unit, and a cooling unit in order.

The application unit 5A is a mechanism which applies the reactive liquid onto the transfer member 2 before the print unit 3 discharges ink. The reactive liquid is a liquid that contains a component increasing an ink viscosity. An increase in ink viscosity here means that a coloring material, a resin, and the like that form the ink react chemically or suck physically by contacting the component that increases the ink viscosity, recognizing the increase in ink viscosity. This increase in ink viscosity includes not only a case in which an increase in viscosity of entire ink is recognized but also a case in which a local increase in viscosity is generated by coagulating some of components such as the coloring material and the resin that form the ink.

The component that increases the ink viscosity can use, without particular limitation, a substance such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like can be given as a mechanism which applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism which absorbs a liquid component from the ink image on the transfer member 2 before transfer. It is possible to suppress, for example, a blur of an image printed on the print medium P by decreasing the liquid component of the ink image. Describing a decrease in liquid component from another point of view, it is also possible to represent it as condensing ink that forms the ink image on the transfer member 2. Condensing the ink means increasing the content of a solid content such as a coloring material or a resin included in the ink with respect to the liquid component by decreasing the liquid component included in the ink.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or smaller than 10 μm in order to suppress adherence of an ink solid content to the liquid absorbing member. The pore size here refers to an average diameter and can be measured by a known means such as a mercury intrusion technique, a nitrogen adsorption method, an SEM image observation, or the like. Note that the liquid component does not have a fixed shape, and is not particularly limited if it has fluidity and an almost constant volume. For example, water, an organic solvent, or the like contained in the ink or reactive liquid can be given as the liquid component.

The heating unit 5C is a mechanism which heats the ink image on the transfer member 2 before transfer. A resin in the ink image melts by heating the ink image, improving transferability to the print medium P. A heating temperature can be equal to or higher than the minimum film forming temperature (MFT) of the resin. The MFT can be measured by each apparatus that complies with a generally known method such as JIS K 6828-2: 2003 or ISO 2115: 1996. From the viewpoint of transferability and image robustness, the ink image may be heated at a temperature higher than the MFT by 10° C. or higher, or may further be heated at a temperature higher than the MFT by 20° C. or higher. The heating unit 5C can use a known heating device, for example, various lamps such as infrared rays, a warm air fan, or the like. An infrared heater can be used in terms of heating efficiency.

The cleaning unit 5D is a mechanism which cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like as needed. A known shape such as a roller shape or a web shape can be used for a cleaning member used for cleaning.

The cooling unit 5E is an air blowing mechanism which blows air to the transfer member 2 which has been cleaned by the cleaning unit 5D. As described later, an amount of air blow is controlled based on temperatures detected by a plurality of temperature sensors provided around the transfer member 2, and consequently the cooling effect is controlled.

As described above, in this embodiment, the application unit 5A, the absorption unit 5B, the heating unit 5C, the cleaning unit 5D, and the cooling unit 5E are included as the peripheral units. However, the present invention is not limited to separate units as shown in FIG. 1. For example, a cooling function equivalent to that of the cooling unit 5E of the transfer member 2 may be added to the application unit 5A or the cleaning unit 5D. In this embodiment, there is a case where a temperature of the transfer member 2 rises due to heat of the heating unit 5C. After the print unit 3 discharges ink to the transfer member 2, if a temperature of an ink image exceeds a boiling temperature of water which is main solvent of ink, absorption performance of a liquid component in the absorption unit 5B may deteriorate. Thus, the transfer member 2 is cooled such that the temperature of discharged ink is maintained to be less than a water boiling point, making it possible to maintain absorption performance of a liquid component.

Note that in addition to the air blowing mechanism, an arrangement in which a member (e.g. a roller) is brought into contact with the transfer member 2, and the member is cooled by the air blowing mechanism may be added to the cooling unit 5E. Furthermore, a mechanism in which the cooling unit 5E cools a cleaning member of the cleaning unit 5D may be provided. A cooling timing may be a period before application of the reactive liquid after transfer.

<Supply Unit>

The supply unit 6 is a mechanism which supplies ink to each printhead 30 of the print unit 3. The supply unit 6 may be provided on the rear side of the printing system 1. The supply unit 6 includes a reservoir TK that reserves ink for each kind of ink. Each reservoir TK may be made of a main tank and a sub tank. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism which deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is positioned lower than the ink discharge surface of the printhead 30.

Note that an ink circulation mechanism between the printhead 30 and a buffer tank of the reservoir TK will be described in detail later.

<Conveyance Apparatus>

The conveyance apparatus 1B is an apparatus that feeds the print medium P to the transfer unit 4 and discharges, from the transfer unit 4, the printed product P' to which the ink image was transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit where the plurality of print media P are stacked and a feeding mechanism which feeds the print media P one by one from the stacking unit to the most upstream conveyance drum 8. Each of the conveyance drums 8 and 8*a* is a rotating body that rotates about the rotation axis in the Y direction and has a columnar outer peripheral surface. At least one grip mechanism which grips the leading edge portion of the print medium P (printed product P') is provided on the outer peripheral surface of each of the conveyance drums 8 and 8*a*. A gripping operation and release operation of each grip mechanism may be controlled such that the print medium P is transferred between the adjacent conveyance drums.

The two conveyance drums 8*a* are used to reverse the print medium P. When the print medium P undergoes double-side printing, it is not transferred to the conveyance drum 8 adjacent on the downstream side but transferred to the conveyance drums 8*a* from the pressurizing drum 42 after transfer onto the surface. The print medium P is reversed via the two conveyance drums 8*a* and transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 positioned at a downstream end to each grip mechanism of the chain 8*c*, and the printed product P' gripped by the grip mechanism is conveyed to the collection unit 8*d* by running the chain 8*c*, releasing gripping. Consequently, the printed product P' is stacked in the collection unit 8*d*.

<Post Processing Unit>

The conveyance apparatus 1B includes post processing units 10A and 10B. The post processing units 10A and 10B are mechanisms which are arranged on the downstream side of the transfer unit 4, and perform post processing on the printed product P'. The post processing unit 10A performs processing on the obverse surface of the printed product P', and the post processing unit 10B performs processing on the reverse surface of the printed product P'. The contents of the post processing includes, for example, coating that aims at protection, improving glossiness, and the like, of an image on the image printed surface of the printed product P'. For example, liquid application, sheet welding, lamination, and the like, can be used as an example of coating.

<Inspection Unit>

The conveyance apparatus 1B includes inspection units 9A and 9B. The inspection units 9A and 9B are mechanisms which are arranged on the downstream side of the transfer unit 4, and inspect the printed product P'.

In this embodiment, the inspection unit 9A is an image capturing apparatus that captures an image printed on the printed product P' and includes an image sensor, for example, a CCD sensor, a CMOS sensor, or the like. The inspection unit 9A captures a printed image while a printing operation is performed continuously. Based on the image captured by the inspection unit 9A, it is possible to confirm a temporal change in tint, or the like, of the printed image and determine whether to correct image data or print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images, or may inspect the images on one sheet, for every predetermined number of sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*. The inspection unit 9B may be a scanner that scans the printed product P'.

<Control Unit>

Figure 4:
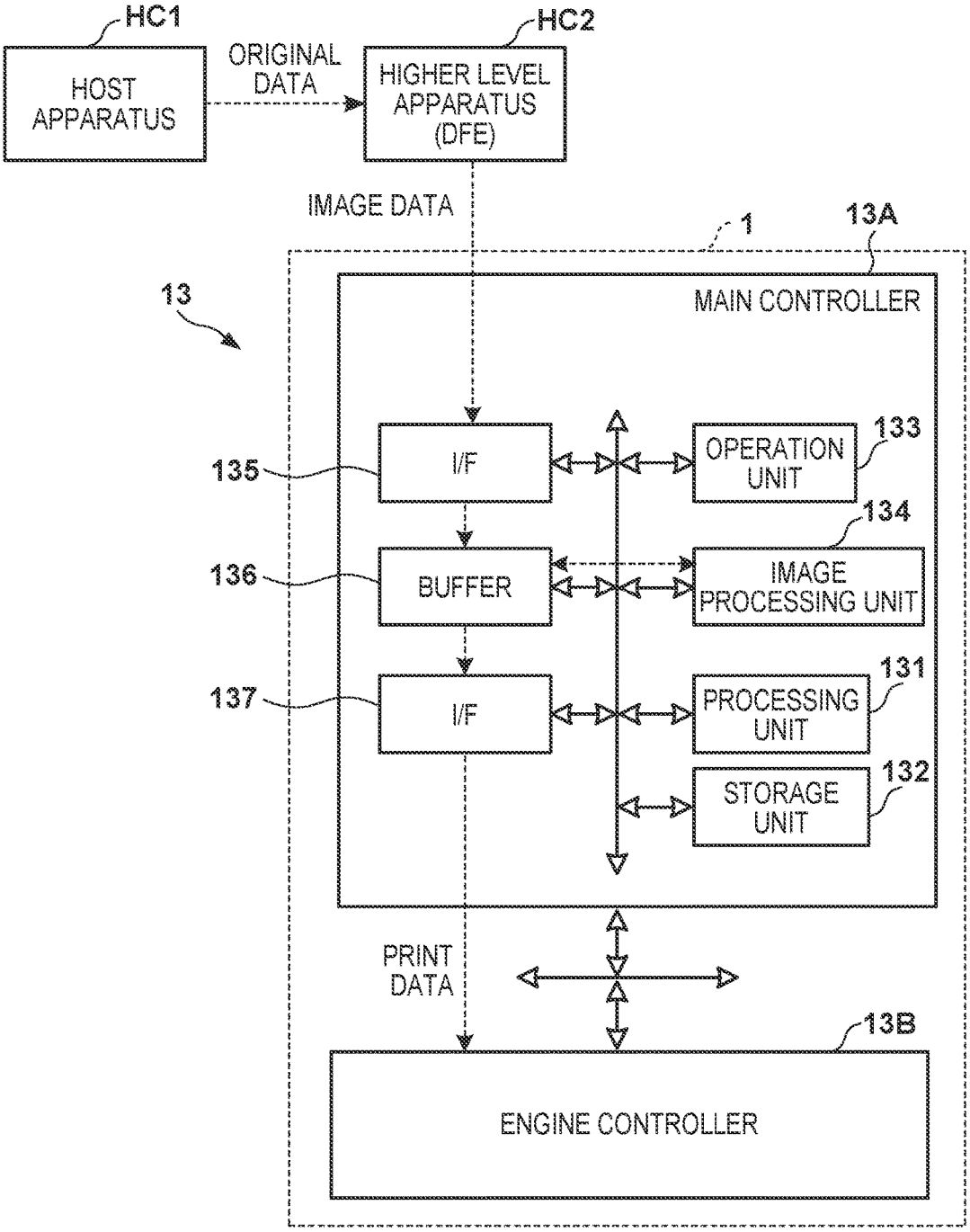
FIG. 4 is a block diagram showing a control system of the printing system in FIG. 1.
Figure 5:
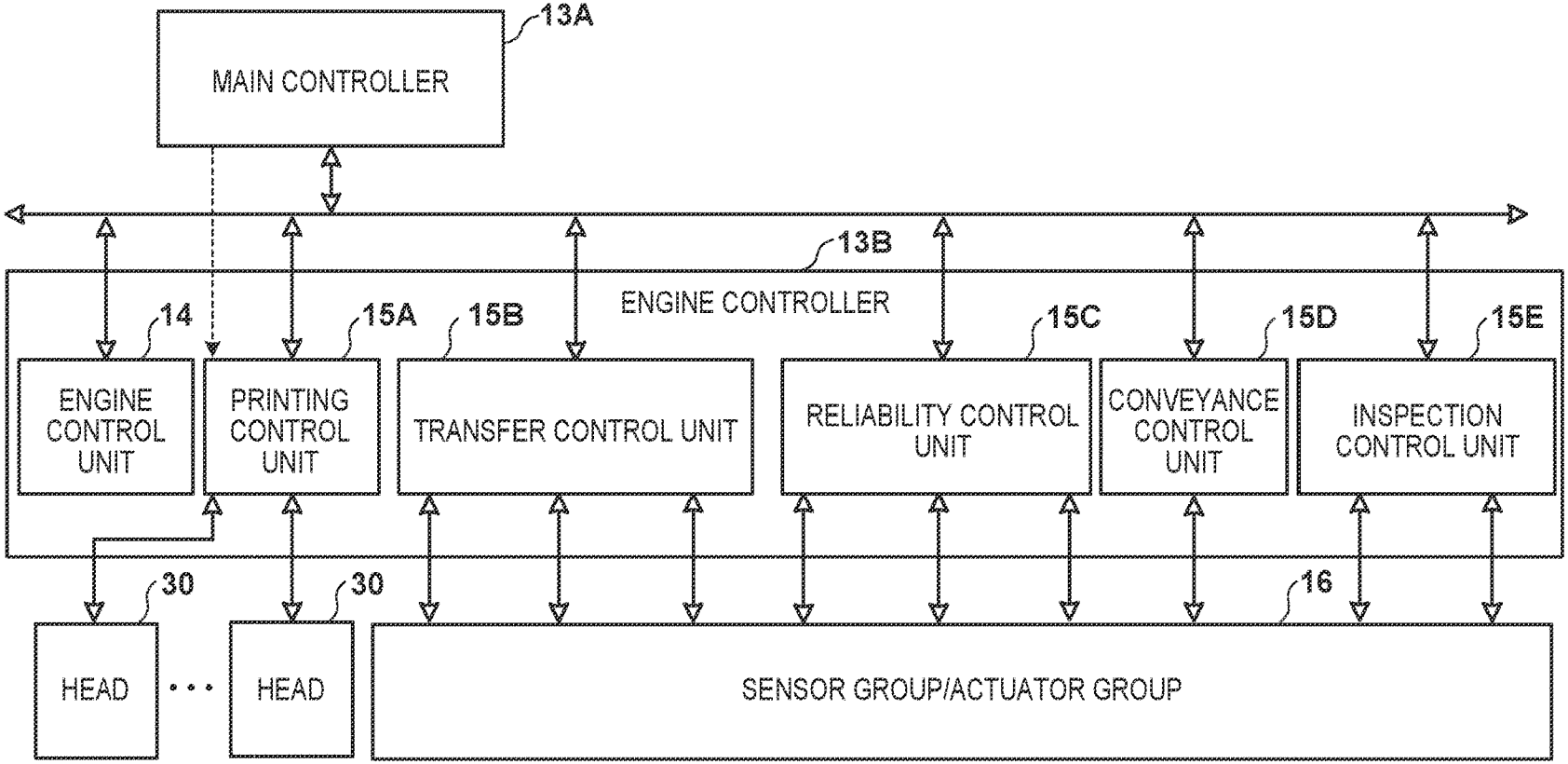
FIG. 5 is a block diagram showing the control system of the printing system in FIG. 1.

A control unit of the printing system 1 will be described next. FIGS. 4 and 5 are block diagrams each showing a control unit 13 of the printing system 1. The control unit 13 is communicably connected to a higher level apparatus (DFE) HC2, and the higher level apparatus HC2 is communicably connected to a host apparatus HC1.

The host apparatus HC1 may be, for example, a PC (Personal Computer) serving as an information processing apparatus, or a server apparatus. A communication method between the host apparatus HC1 and the higher level apparatus HC2 may be, without particular limitation, either wired or wireless communication.

Original data to be the source of a printed image is generated or saved in the host apparatus HC1. The original data here is generated in the format of, for example, an electronic file such as a document file or an image file. This original data is transmitted to the higher level apparatus HC2. In the higher level apparatus HC2, the received original data is converted into a data format (for example, RGB data that represents an image by RGB) available by the control unit 13. The converted data is transmitted from the higher level apparatus HC2 to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication I/F (interface) 135, a buffer 136, and a communication I/F 137.

The processing unit 131 is a processor such as a CPU, executes programs stored in the storage unit 132, and controls the entire main controller 13A. The storage unit 132 is a storage device such as a RAM, a ROM, a hard disk, or an SSD, stores data and the programs executed by the processing unit (CPU) 131, and provides the processing unit (CPU) 131 with a work area. An external storage unit may further be provided in addition to the storage unit 132. The operation unit 133 is, for example, an input device such as a touch panel, a keyboard, or a mouse and accepts a user instruction. The operation unit 133 may be formed by an input unit and a display unit integrated with each other. Note that a user operation is not limited to an input via the operation unit 133, and an arrangement may be possible in which, for example, an instruction is accepted from the host apparatus HC1 or the higher level apparatus HC2.

The image processing unit 134 is, for example, an electronic circuit including an image processing processor. The buffer 136 is, for example, a RAM, a hard disk, or an SSD. The communication I/F 135 communicates with the higher level apparatus HC2, and the communication I/F 137 communicates with the engine controller 13B. In FIG. 4, broken-line arrows exemplify the processing sequence of image data. Image data received from the higher level apparatus HC2 via the communication I/F 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication I/F 137 to the engine controller 13B as print data used by a print engine.

As shown in FIG. 5, the engine controller 13B includes an engine control units 14 and 15A to 15E, and obtains a detection result of a sensor group/actuator group 16 of the printing system 1 and controls driving of the groups. Each of these control units includes a processor such as a CPU, a storage device such as a RAM or a ROM, and an interface with an external device. Note that the division of the control units is merely illustrative, and a plurality of subdivided control units may perform some of control operations or conversely, the plurality of control units may be integrated with each other, and one control unit may be configured to implement their control contents.

The engine control unit 14 controls the entire engine controller 13B. The printing control unit 15A converts print data received from the main controller 13A into raster data or the like in a data format suitable for driving of the printheads 30. The printing control unit 15A controls discharge of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism which moves the print unit 3 between the discharge position POS1 and the recovery position POS3.

The conveyance control unit 15D controls driving of the transfer unit 4 and controls the conveyance apparatus 1B. The inspection control unit 15E controls the inspection unit 9B and the inspection unit 9A.

Of the sensor group/actuator group 16, the sensor group includes a sensor that detects the position and speed of a movable part, a sensor that detects a temperature, an image sensor, and the like. The actuator group includes a motor, an electromagnetic solenoid, an electromagnetic valve, and the like.

<Operation Example>

Figure 6:
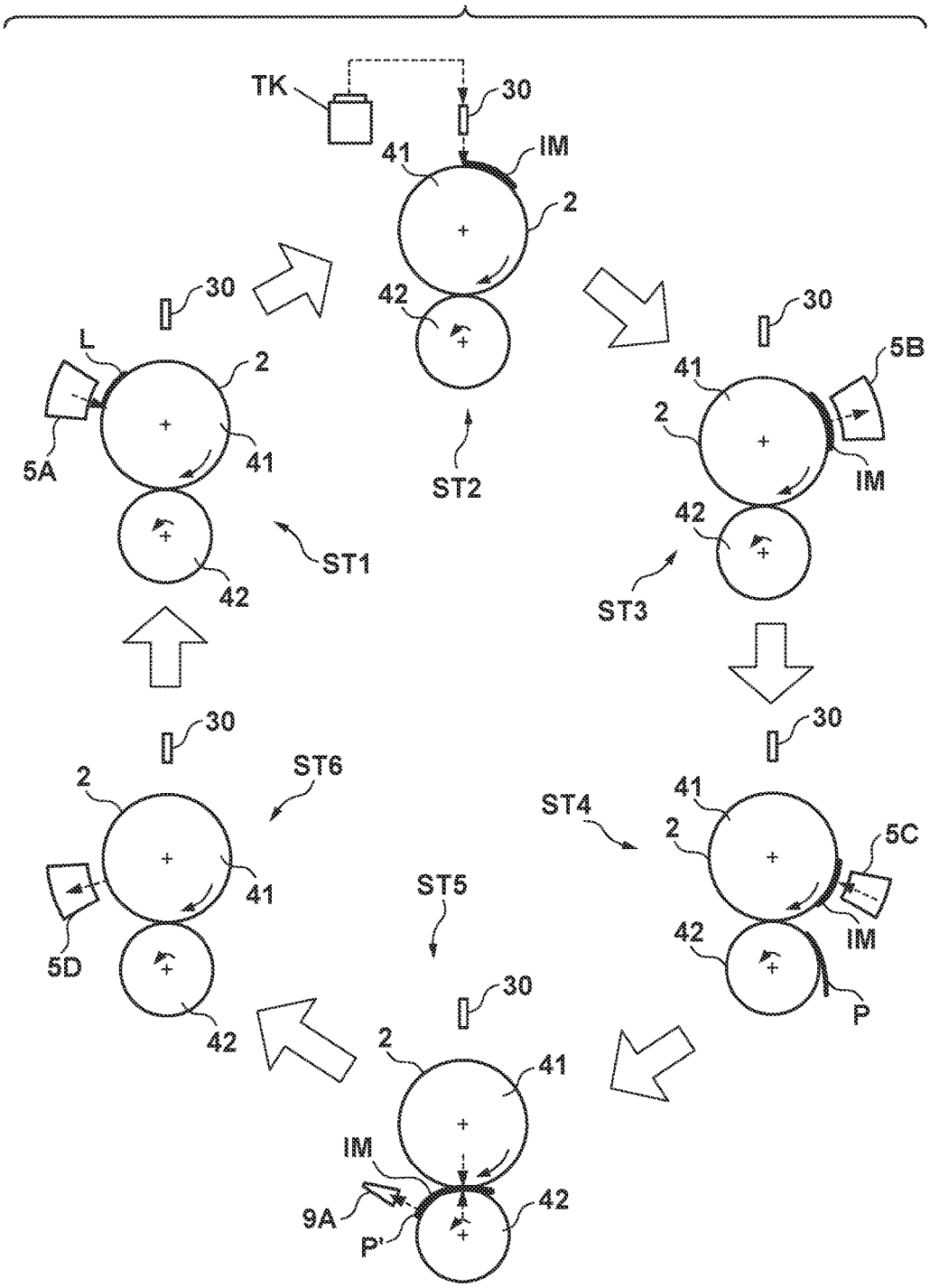
FIG. 6 is an explanatory view showing an example of the operation of the printing system in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion to which the reactive liquid L on the transfer member 2 is applied moves along with the rotation of the transfer drum 41. When the portion to which the reactive liquid L is applied reaches under the printhead 30, ink is discharged from the printhead 30 to the transfer member 2 as shown in a state ST2. Consequently, an ink image IM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, as shown in a state ST3, the absorption unit 5B absorbs a liquid component from the ink image IM. When the ink image IM reaches the heating unit 5C, as shown in a state ST4, the heating unit 5C heats the ink image IM, a resin in the ink image IM melts, and a film of the ink image IM is formed. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P' is formed. Passing through the nip portion, the inspection unit 9A captures an image printed on the printed product P' and inspects the printed image. The conveyance apparatus 1B conveys the printed product P' to the collection unit 8*d*.

When a portion where the ink image IM on the transfer member 2 is formed reaches the cleaning unit 5D, it is cleaned by the cleaning unit 5D as shown in a state ST6. After the cleaning, the transfer member 2 rotates once, and transfer of the ink image to the print medium P is performed repeatedly in the same procedure. The description above has been given such that transfer of the ink image IM to one print medium P is performed once in one rotation of the transfer member 2 for the sake of easy understanding. It is possible, however, to continuously perform transfer of the ink image IM to the plurality of print media P in one rotation of the transfer member 2.

Each printhead 30 needs maintenance if such a printing operation continues.

Figure 7:
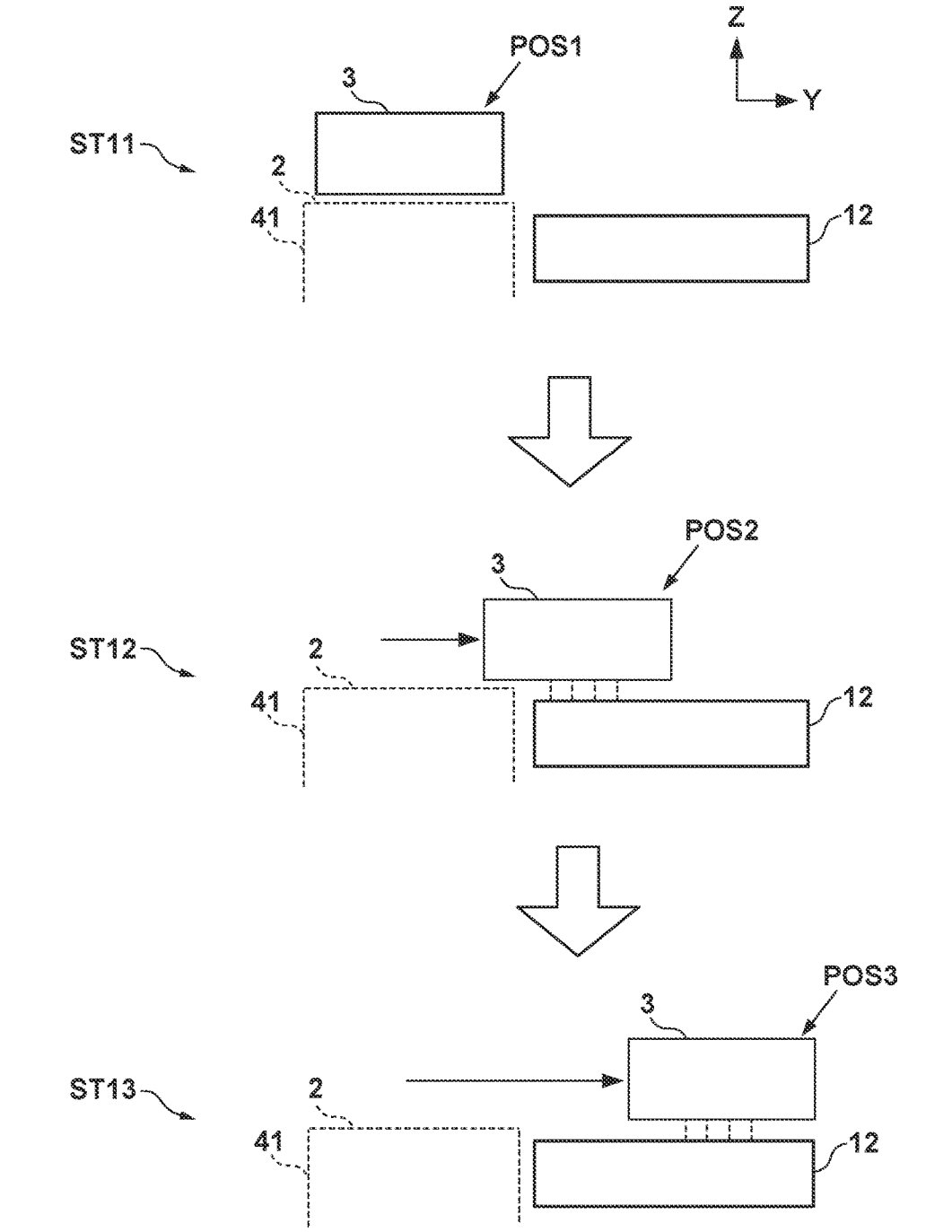
FIG. 7 is an explanatory view showing an example of the operation of the printing system in FIG. 1.

FIG. 7 shows an operation example at the time of maintenance of each printhead 30. A state ST11 shows a state in which the print unit 3 is positioned at the discharge position POS1. A state ST12 shows a state in which the print unit 3 passes through the preliminary recovery position POS2. Under passage, the recovery unit 12 performs a process of recovering discharge performance of each printhead 30 of the print unit 3. Subsequently, as shown in a state ST13, the recovery unit 12 performs the process of recovering the discharge performance of each printhead 30 in a state in which the print unit 3 is positioned at the recovery position POS3.

Control of effectively cooling and heating the transfer member 2, and properly maintaining the temperature of the transfer member 2 in the printing system having the above arrangement will be described next.

<Temperature Control of Transfer Member>

Figure 8:
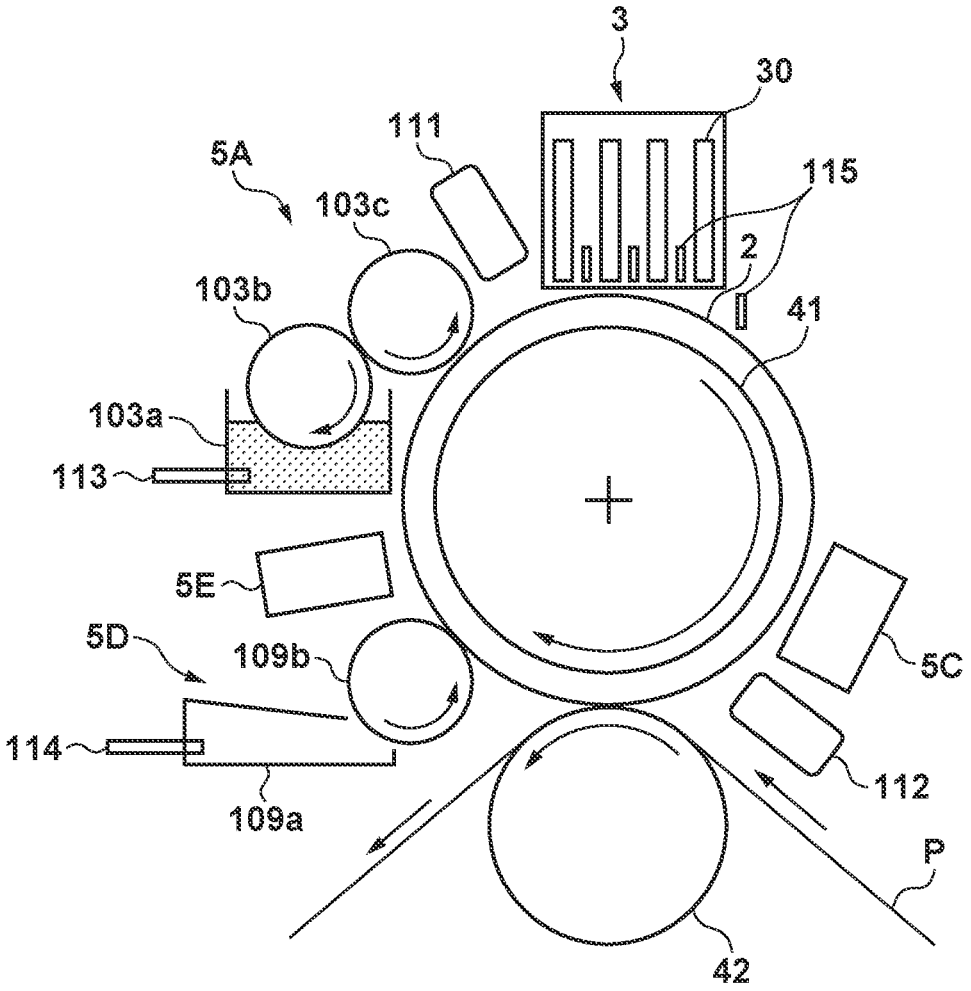
FIG. 8 is a view schematically showing constituent elements provided around the transfer member in order to perform temperature control of the transfer member.

FIG. 8 is a view schematically showing constituent elements provided around the transfer member in order to perform temperature control of the transfer member. Note that in FIG. 8, out of the various constituent elements of the printing system shown in FIG. 1, portions that are not directly related to the temperature control of the transfer member are not illustrated. Also in FIG. 8, the same reference numerals denote the constituent elements that have already been described with reference to FIG. 1, and a description thereof will not be repeated.

As shown in FIG. 8, with respect to a rotation direction of the transfer member 2, a temperature sensor 111 is provided on the downstream side of the application unit 5A, and a temperature sensor 112 is provided on the downstream side of the heating unit 5C. By thus arranging the two temperature sensors, the temperature of the transfer member 2 cooled by the cleaning unit 5D, the cooling unit 5E, and the application unit 5A is detected, and the temperature of the transfer member 2 heated by the heating unit 5C is detected. Each of the temperature sensors 111 and 112 is a non-contact sensor that detects the temperature of the transfer member 2 by detecting infrared rays radiated from the surface of the transfer member 2.

With such an arrangement, the temperature of the transfer member 2 is held between $T_1$° C. and $T_2$° C. immediately below the print unit 3. On the other hand, the temperature is held between $T_3$° C. and $T_4$° C. in the nip portion between the transfer drum 41 to which an image is transferred and the pressurizing drum 42.

The application unit 5A includes a reactive liquid container 103*a* that contains the reactive liquid L applied to the transfer member 2, a roller 103*b* that extracts the reactive liquid L contained in the reactive liquid container 103*a*, and a roller 103*c* that applies the reactive liquid L impregnated in the roller 103*b* to the transfer member 2. The reactive liquid container 103*a* includes a cooling mechanism that cools the reactive liquid L to a predetermined temperature or lower and holds it there. The reactive liquid container 103*a* includes a temperature sensor 113 that measures the temperature of the reactive liquid L.

The cleaning unit 5D includes a cleaning liquid (CL liquid) container 109*a* that contains a CL liquid used to clean the transfer member 2 and a roller 109*b* that applies the CL liquid contained there to the transfer member 2. The CL liquid container 109*a* includes a cooling mechanism that cools the CL liquid to a predetermined temperature or lower and holds it there. The CL liquid container 109*a* includes a temperature sensor 114 that measures the temperature of the CL liquid.

As can be seen in the above arrangement, the transfer member 2 is cooled to some extent by applying the reactive liquid L with the application unit 5A and applying the CL liquid with the cleaning unit 5D. Therefore, it can be said that the application unit 5A and the cleaning unit 5D include liquid-cooled cooling functions. Note that each of the temperature sensor 113 and the temperature sensor 114 may be included in the liquid container as in this embodiment, or may be included in a liquid supply channel or liquid cooling circulating channel (not shown).

In addition to this, as described above, the cooling unit 5E is provided between the application unit 5A and the cleaning unit 5D. The cooling unit 5E includes a fan that blows air to the transfer member 2 and a controller that controls the air blowing amount. Therefore, it can be said that the cooling unit 5E in this embodiment includes an air-cooled cooling function.

As described above, the printing system in this embodiment includes a cooling mechanism that cools the transfer member 2 in the sequence of liquid cooling, air cooling, and liquid cooling with respect to the rotation direction of the transfer member 2. Such a sequence is decided in order to achieve an efficient cooling effect on the transfer member 2.

As can be seen in the above arrangement, the temperature control of the transfer member 2 is performed based on temperatures detected by four temperature sensors 111 to 114.

Furthermore, as shown in FIG. 8, with respect to the rotation direction of the transfer member 2, humidity sensors 115 may be provided between the plurality of printheads 30 mounted on the print unit 3, or on the most downstream side of the printheads 30 and outside the print unit 3. By arranging the humidity sensor 115 on the most downstream side of the printheads 30 and outside the print unit 3, it is possible to detect humidity in a location where ink is discharged the most on the transfer member 2.

Figure 9:
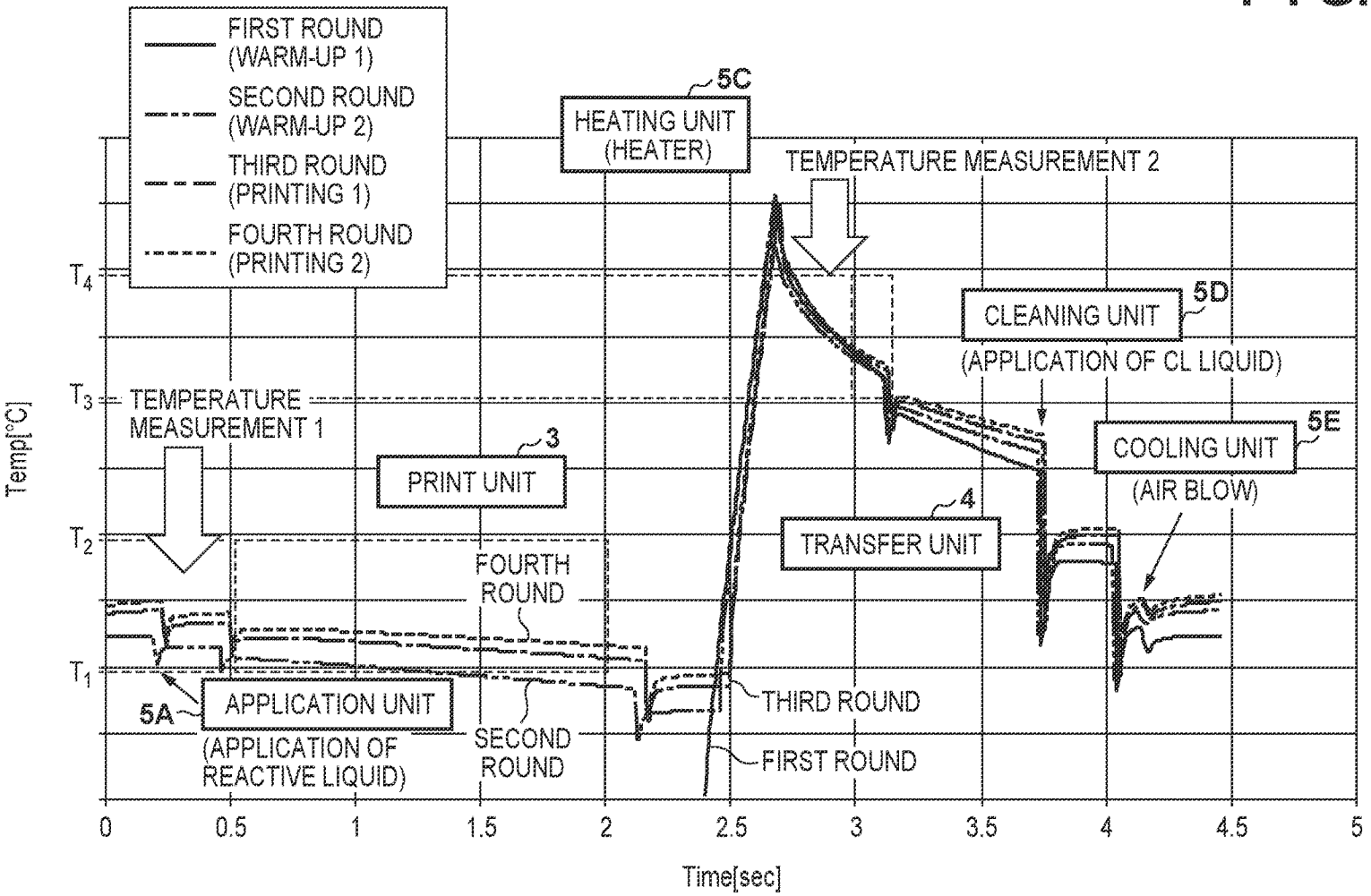
FIG. 9 is a timing chart showing change over time of the surface temperature of the transfer member.

FIG. 9 is a timing chart showing change over time of the surface temperature of the transfer member.

The transfer member 2 of this embodiment performs a printing operation while rotating at a rotation speed of one rotation in 4.5 sec. FIG. 9 shows how the surface temperature changes during one rotation of a given point on the surface of the transfer member 2. FIG. 9 shows temperature profiles of respective rounds obtained by rotating the transfer member 2 four times, and they are indicated as the first round, the second round, the third round, and the fourth round, respectively. Each round starts when an arbitrary point of the transfer member 2 is in a portion between the application unit 5A and the cooling unit 5E, and ends when the transfer member 2 rotates once, and the point returns to the portion between the application unit 5A and the cooling unit 5E. Thus, in FIG. 9, the origin (0 point) on a time axis (abscissa) is the start point of each round, and 4.5 sec is the end point of the round.

According to FIG. 9, a warm-up operation (warm-up 1) of the printing system is performed in the first round, a warm-up operation (warm-up 2) of the printing system is also performed in the second round, and then printing operations (printing 1 and printing 2) of the printing system are performed in the third and fourth rounds.

As shown in FIG. 9, the arbitrary point of the transfer member 2 passes through locations where the application unit 5A, the print unit 3, the heating unit 5C, the transfer unit 4, the cleaning unit 5D, and the cooling unit 5E are provided in its rotation. Then, in temperature measurement 1, the temperature sensor 111 measures the temperature of the transfer member 2 and in temperature measurement 2, the temperature sensor 112 measures the temperature of the transfer member 2. These measured temperatures are fed back to control of a heating operation of the transfer member 2 by the heating unit 5C and a cooling operation of the transfer member 2 by the cooling unit 5E. Cooling control also includes controlling the temperature of the reactive liquid L measured by the temperature sensor 113, the temperature of the CL liquid measured by the temperature sensor 114, and the operation of the cooling mechanism (chiller) so as to fall within a predetermined temperature range. Detailed temperature control of the transfer member 2 by the temperatures measured by the temperature sensors 111 to 114 will be described later.

As can be seen in FIG. 9, the temperature profiles of the transfer member 2 are different in the respective rounds. According to the temperature profiles, however, the temperature of the transfer member 2 decreases by applying the reactive liquid L with the application unit 5A. The temperature of the transfer member 2 also decreases by applying the CL liquid with the cleaning unit 5D. Furthermore, the temperature of the transfer member 2 also decreases due to an air blow by the cooling unit 5E. On the other hand, the temperature of the transfer member 2 increases by heating a heater with the heating unit 5C.

In this embodiment, based on the temperatures measured by the four temperature sensors 111 to 114 during one or two rotations of the transfer member 2 while the printing system undergoes the warm-up operations, temperature control processing is performed such that the temperature of the transfer member 2 falls within a predetermined range. A reason for performing temperature control during the warm-up operations is as follows. That is, when the transfer member 2 passes through the discharge region R2, poor coagulation of ink occurs if the temperature of the transfer member 2 is lower than $T_1$° C., deteriorating the quality of a formed image. On the other hand, moisture of ink evaporates if the temperature of the transfer member 2 exceeds $T_2$° C., contracting a resin component and breaking an image formed by ink discharge. Moreover, when the transfer member 2 passes through the transfer region R6, image transfer becomes unsatisfactory if the temperature of the transfer member 2 is lower than $T_3$° C., and durability of a blanket (transfer member 2) degrades if the temperature exceeds $T_4$° C.

Therefore, by performing the temperature control processing of the transfer member during the warm-up operations, the temperature of the transfer member 2 is maintained between $T_1$° C. and $T_2$° C. when the transfer member 2 passes through the discharge region R2. On the other hand, control is performed so as to maintain the temperature of the transfer member 2 between $T_3$° C. and $T_4$° C. when the transfer member 2 passes through the transfer region R6. Thus, the temperature of the transfer member 2 is maintained between $T_1$° C. and $T_2$° C. when the transfer member 2 passes through the discharge region R2 by the print unit 3 in the third and fourth rounds. Moreover, the temperature of the transfer member 2 is maintained between $T_3$° C. and $T_4$° C. when the transfer member 2 passes through the transfer region R6 by the transfer unit 4.

Then, during the printing operations, the temperature of the transfer member is controlled based on the temperatures measured by the four temperature sensors in order to perform satisfactory image formation and image transfer while suppressing the influence of an external disturbance (an environment temperature, a drum temperature of the transfer member, ink latent heat, color unevenness, or the like).

Figure 10A:
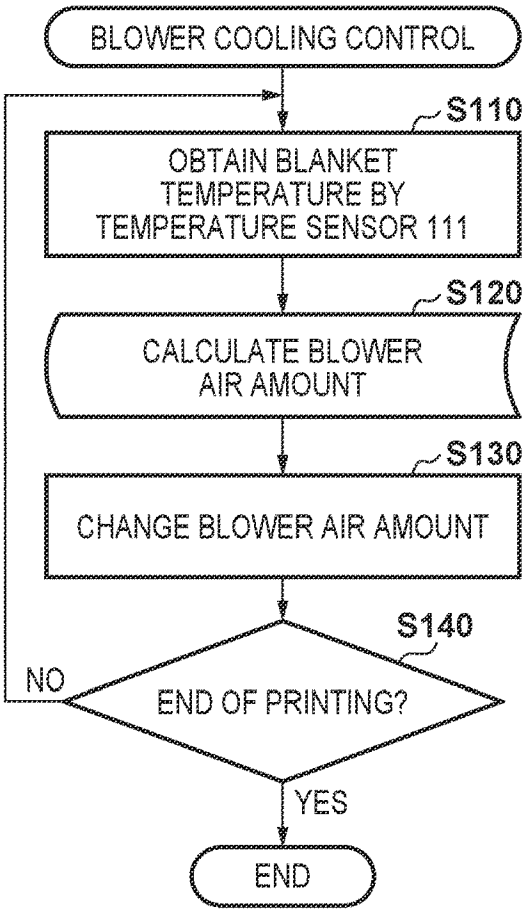
FIGS. 10A, 10B and 10C are flowcharts showing the temperature control of the transfer member based on the temperatures measured by the four temperature sensors.
Figure 10B:
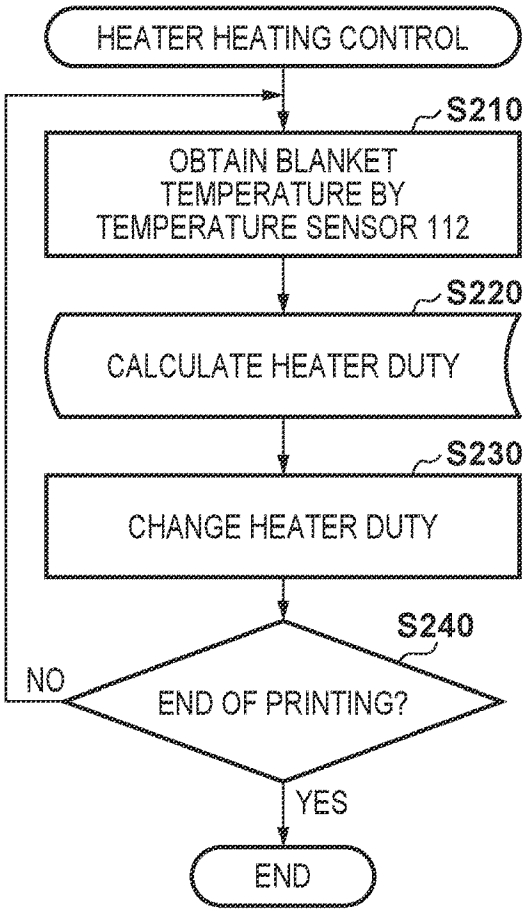
Figure 10C:
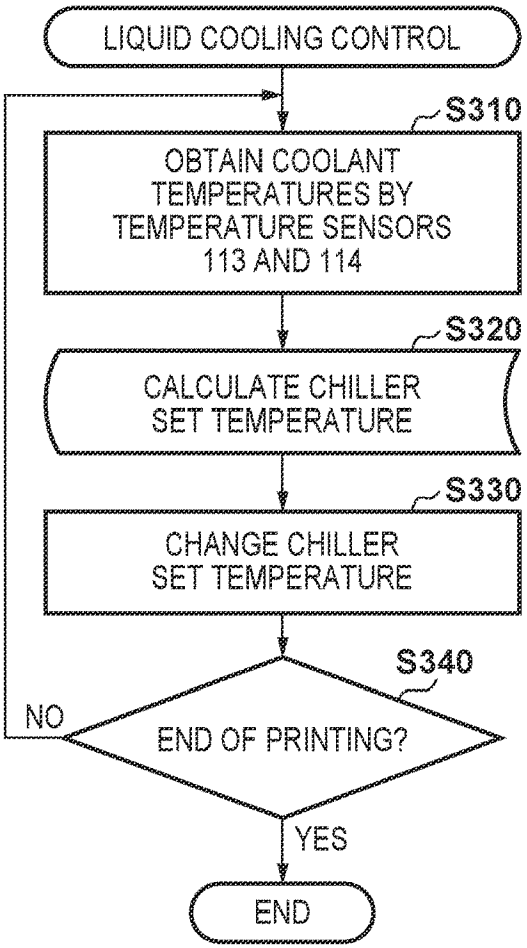

FIGS. 10A to 10C are flowcharts showing the temperature control of the transfer member based on the temperatures measured by the four temperature sensors.

FIG. 10A is the flowchart showing cooling control based on the temperature measured by the temperature sensor 111. FIG. 10B is the flowchart showing heating control based on the temperature measured by the temperature sensor 112. Furthermore, FIG. 10C is the flowchart showing cooling control based on the temperatures measured by the temperature sensors 113 and 114.

According to FIG. 10A, in step S110 during a printing operation, the temperature sensor 111 measures and obtains the temperature of the transfer member 2 on the immediately downstream side of the application unit 5A with respect to the rotation direction of the transfer member 2. In step S120, the air blow amount of the cooling unit 5E is calculated based on the measured temperature. In general, a cooling capability improves as the air blow amount is larger. Therefore, calculation is performed so as to increase the air blow amount as the temperature of the transfer member 2 is higher.

Furthermore, in step S130, as compared with the calculated air blow amount, a current air blow amount is changed to the calculated air blow amount when the change is necessary. Then, in step S140, it is checked whether a temperature when the transfer member 2 passes through the discharge region R2 and a temperature when the transfer member 2 passes through the transfer region R6 fall within the above-described temperature range. Here, if they fall within such a temperature range, it is determined that the printing operation can be continued, and the process returns to step S110. If they fall outside the temperature range, the printing operation is stopped.

According to FIG. 10B, in step S210 during the printing operation, the temperature sensor 112 measures and obtains the temperature of the transfer member 2 on the immediate downstream side of the heating unit 5C with respect to the rotation direction of the transfer member 2. In step S220, the heater Duty of the heating unit 5C is calculated based on the measured temperature. In general, a heating capability improves as the Duty is higher. Therefore, a calculation is performed so as to increase the Duty as the temperature of the transfer member 2 is lower. In this embodiment, a heater incorporated in the heating unit 5C undergoes PWM-control to be heated. Accordingly, the heat generation amount of the heater increases by increasing a PWM-duty.

Furthermore, in step S230, as compared with the calculated Duty, a current Duty is changed to the calculated Duty when the change is necessary. Then, in step S240, it is checked whether the temperature when the transfer member 2 passes through the discharge region R2 and the temperature when the transfer member 2 passes through the transfer region R6 fall within the above-described temperature range. Here, if they fall within such a temperature range, it is determined that the printing operation can be continued, and the process returns to step S210. If they fall outside the temperature range, the printing operation is stopped.

According to FIG. 10C, in step S310 during the printing operation, the temperature sensors 113 and 114 measure and obtain the temperatures of the reactive liquid L and the CL liquid, respectively. In step S320, based on these measured temperatures, the set temperatures of respective cooling mechanisms (chillers) in the application unit 5A and the cleaning unit 5D are calculated. In general, a cooling capability improves the lower the set temperatures are. Therefore, calculation is performed so as to decrease the setting temperatures the higher the temperature of the transfer member 2 is.

Furthermore, in step S330, the calculated setting temperatures are compared with current set temperatures, and a change is made to the calculated set temperatures when the change is necessary. Then, in step S340, it is checked whether the temperature when the transfer member 2 passes through the discharge region R2 and the temperature when the transfer member 2 passes through the transfer region R6 fall within the above-described temperature range. Here, if they fall within such a temperature range, it is determined that the printing operation can be continued, and the process returns to step S310. If they fall outside the temperature range, the printing operation is stopped.

Therefore, according to the above-described embodiment, it is possible to maintain the temperature of the transfer member in a proper range by controlling the cooling capability of each cooling mechanism and the heating capability by the heater of the heating unit based on temperatures measured by a plurality of temperature sensors.

<Temperature Control of Printhead>

During a printing operation, each printhead 30 discharges ink, setting air present between the printhead 30 and the transfer member 2 in a high-humid state. On the other hand, as will be described later, the printhead 30 adopts an arrangement which circulates ink with an ink tank, maintaining the temperature of the printhead 30 comparatively low by the circulated ink to be about equal to the environmental temperature of the printing system 1. Therefore, if the temperature of the printhead 30 is lower than the temperature of the transfer member 2, dew condensation may occur in the printhead 30. In particular, if dew condensation occurs in the vicinities of nozzles of the printhead, the dew condensation deviates a discharge direction of each discharged ink droplet or a dew drop falls to the transfer member 2, deteriorating the quality of an image formed on the transfer member 2.

Therefore, in order to prevent dew condensation on the printhead 30, it is desirable that the temperature of the printhead 30 is controlled to a temperature higher than the temperature of the transfer member 2 when the transfer member 2 passes though the discharge region R2. That is, it becomes necessary to maintain the printhead 30 at a temperature higher than the temperature of the transfer member 2 measured by the temperature sensor 111.

In this embodiment, a thermal method of forming a bubble by a heat generating element and discharging a liquid (ink) is adopted. However, the present invention is not limited to this. For example, a printhead which adopts a piezoelectric method and various kinds of liquid discharge methods may be used. An arrangement that circulates a liquid such as ink between a tank and the printhead is adopted here. However, the present invention is not limited by this arrangement. A form may be adopted in which, for example, ink in a pressure chamber is caused to flow by providing two tanks on an upstream side and a downstream side, and causing the ink to flow from one tank to the other tank with respect to a fluid channel direction in the printhead without circulating the liquid.

The printhead 30 uses 20 orifice arrays in order to discharge ink of one color. Therefore, it becomes possible to perform extremely high-speed printing by allotting print data to a plurality of orifice arrays appropriately and performing printing. Furthermore, even if there is an orifice suffering an ink discharge failure, reliability is improved by performing, on the orifice, interpolatory discharge (complementary printing) from orifices of another array at a corresponding position in a conveyance direction of a print medium. This is particularly suitable for commercial printing or the like.

(1) Description of Circulation Channel

Figure 11:
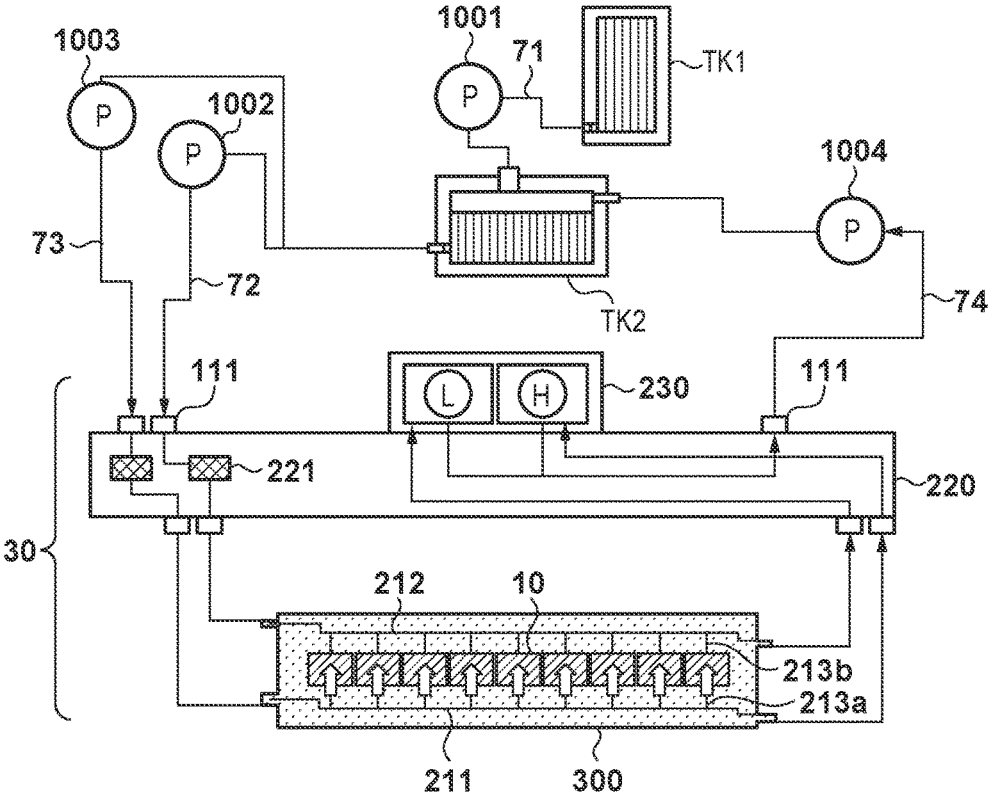
FIG. 11 is a schematic view showing an ink circulation mechanism between the printhead and ink tanks.

FIG. 11 is a schematic view showing an ink circulation mechanism between the printhead and ink tanks.

As shown in FIG. 11, four pumps (P) 1001 to 1004 are used for an ink supplying mechanism in this embodiment. In this embodiment, the reservoir TK that stores ink is formed by a main tank TK1 and a buffer tank TK2, the buffer tank TK2 is connected to the printhead 30, and ink circulates between the buffer tank TK2 and the printhead 30. On the other hand, the pump 1001 is provided in a fluid channel between the main tank TK1 and the buffer tank TK2. The pump 1001 refills the buffer tank TK2 with the ink from the main tank TK1 appropriately.

The fluid channel 6*a* mentioned in FIG. 1 is formed by a fluid channel 71 between the main tank TK1 and the buffer tank TK2, and three fluid channels 72 to 74 between the buffer tank TK2 and the printhead 30, as shown in FIG. 11. The pumps 1002 to 1004 are provided in the fluid channels 72 to 74, respectively.

Ink from the buffer tank TK2 flows into the printhead 30 through a filter 221 from connection ports 111 via the fluid channels 72 and 73. The ink circulates in the printhead and returns from the other connection port 111 to the buffer tank TK2 via the fluid channel 74.

Two pressure regulating mechanisms forming a negative pressure control unit 230 are both mechanisms (mechanical components each having the same action as a so-called "back-pressure regulator") that control a pressure on the upstream side of the negative pressure control unit 230 with respect to an ink fluid channel direction by a variation within a predetermined range centered on a desired set pressure. The pump 1004 acts as a negative pressure source that reduces a pressure on the downstream side of the negative pressure control unit 230. The pump (high-pressure side) 1003 and the pump (low-pressure side) 1002 are arranged on the upstream side of the printhead 30. The negative pressure control unit 230 is arranged on the downstream side of the printhead 30.

Even if there is a variation in ink flow rate caused by a change in print duty by the printhead 30, the negative pressure control unit 230 acts so as to stabilize a pressure fluctuation on the upstream side of itself (that is, the side of a liquid discharge unit 300) within a predetermined range centered on a preset pressure.

As shown in FIG. 11, it is preferable that the pump 1004 pressurizes the downstream side of the negative pressure control unit 230 via a liquid supply unit 220. This makes it possible to suppress an influence of a water head pressure in the buffer tank TK2 to the printhead 30. It is therefore possible to extend a selection range of the layout of the buffer tank TK2 in the printing system 1. Instead of the pump 1004, it is also possible to apply, for example, a water head tank arranged having a predetermined water head difference to the negative pressure control unit 230.

As shown in FIG. 11, the negative pressure control unit 230 includes two pressure regulating mechanisms with different control pressures being set, respectively. Of two negative pressure regulating mechanisms, a high-pressure setting side (denoted as H in FIG. 11) and a low-pressure side (denoted as L in FIG. 11) are, respectively, connected to a common supply fluid channel 211 and common collection fluid channel 212 in the liquid discharge unit 300 via the inside of the liquid supply unit 220. By making a pressure of the common supply fluid channel 211 relatively higher than a pressure of the common collection fluid channel 212 using the two negative pressure regulating mechanisms, an ink flow from the common supply fluid channel 211 to the common collection fluid channel 212 via individual fluid channels 213*a* and 213*b*, and internal fluid channels of respective element substrates 10 occurs.

(2) Description of Printhead Arrangement

Figure 12A:
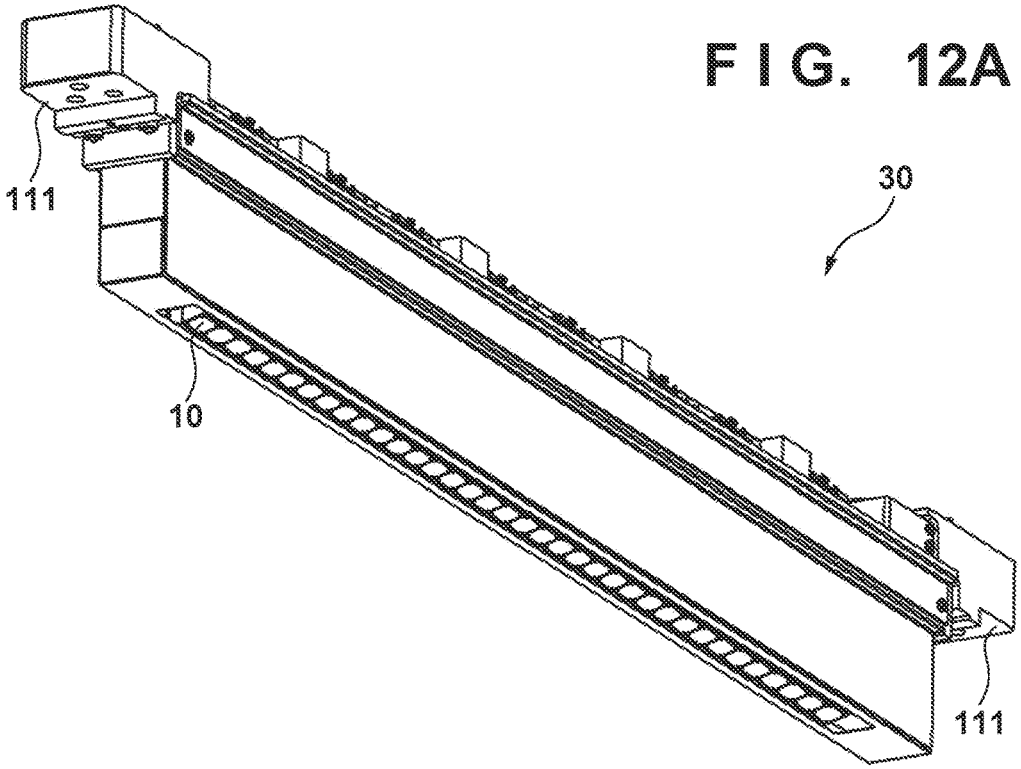
FIGS. 12A and 12B are perspective views each showing the outer appearance of the arrangement of the printhead.
Figure 12B:
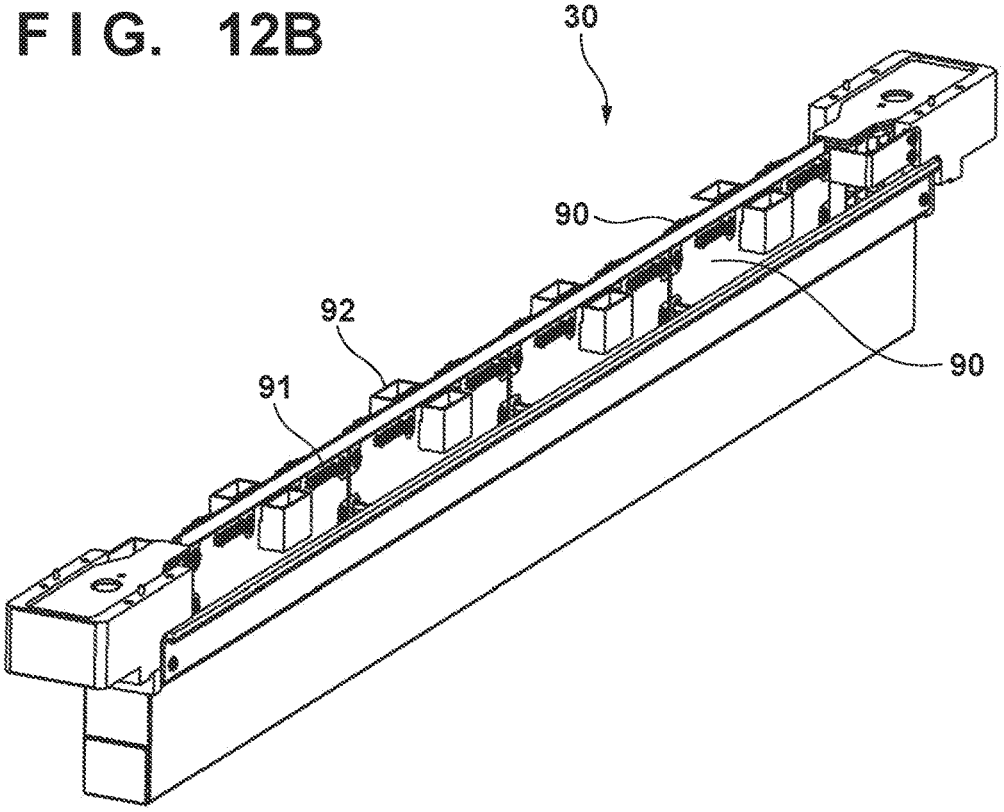

FIGS. 12A and 12B are perspective views each showing the outer appearance of the arrangement of the printhead 30. FIGS. 12A and 12B are the perspective views of the outer appearance in which the printhead 30 is viewed from different angles.

As shown in FIG. 12A, the printhead 30 is a full-line printhead that includes the plurality of element substrates 10 arrayed in a line in its longitudinal direction and has a print width corresponding to the width of a print medium. The printhead 30 also includes the connection portions 111 connected to the buffer tank TK2 on both sides.

On the other hand, as shown in FIG. 12B, the printhead 30 includes signal input terminals 91 and power supply terminals 92 on both sides, and includes electric wiring boards 90 in its upper portion. This is for a reduction in voltage drop or signal transfer delay that occurs in a wiring portion provided in each element substrate 10. The element substrate 10 includes a temperature sensor capable of measuring the temperature of the element substrate and sub heaters (to be described later) capable of heating the element substrate, making it possible to control the temperature of the element substrate at a predetermined temperature.

Figure 13:
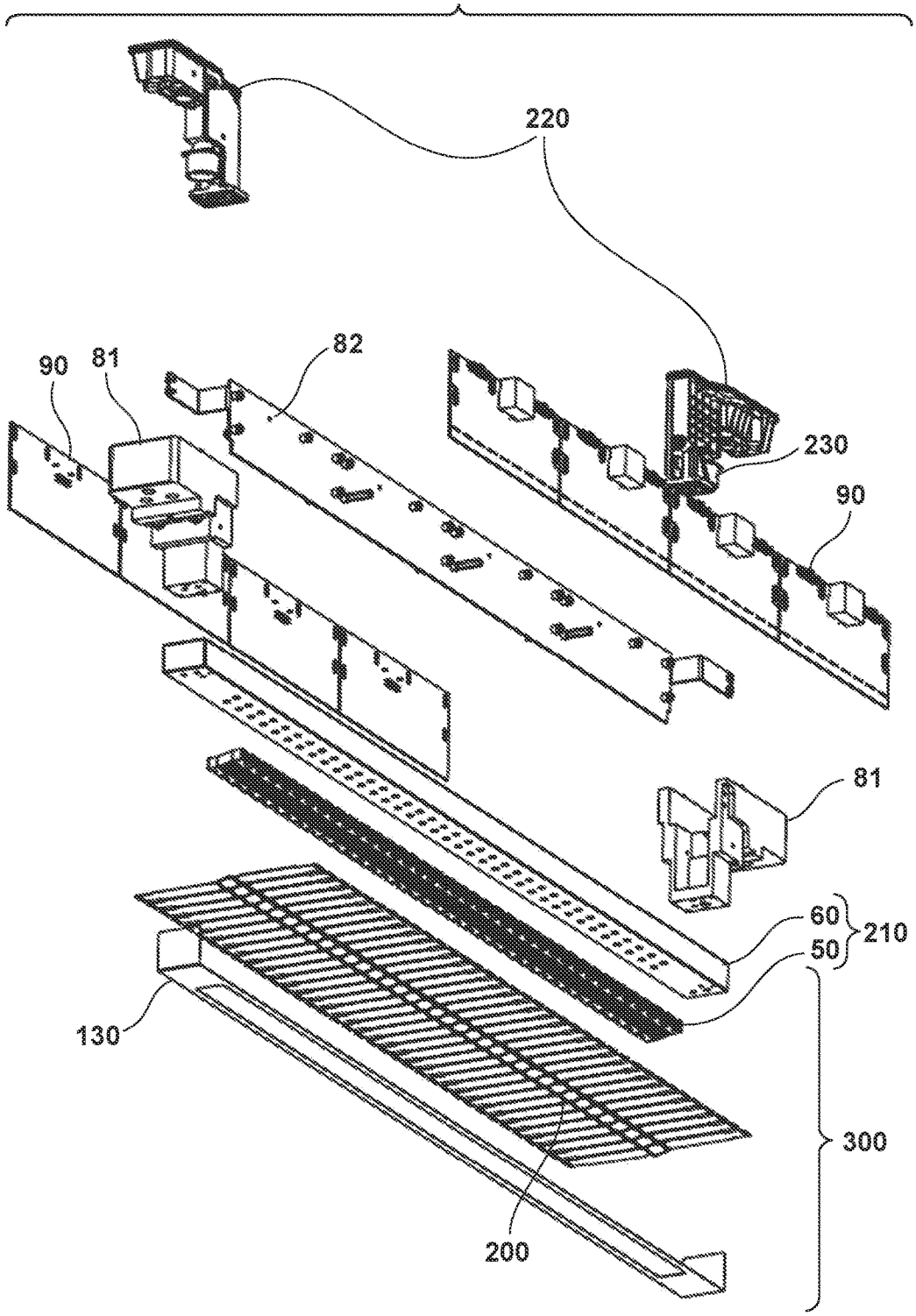
FIG. 13 is a perspective exploded view showing the printhead.

FIG. 13 is a perspective exploded view showing the printhead 30. Respective components or units that form the printhead 30 are divisionally shown for respective functions.

In the printhead 30, the rigidity of the printhead is ensured by a second fluid channel member 60 included in the liquid discharge unit 300. Liquid discharge unit support units 81 are connected to two end portions of the second fluid channel member 60. The liquid discharge unit 300 is mechanically coupled to the carriage 31 of the print unit 3 and performs positioning of the printhead 30. The liquid supply units 220 including the negative pressure control units 230 and the electric wiring boards 90 coupled to an electric wiring board support unit 82 are coupled to the liquid discharge unit support units 81. Filters (not shown) are incorporated in the two liquid supply units 220. The two negative pressure control units 230 are set so as to control a pressure at relatively high and low negative pressures different from each other. If the negative pressure control units 230 on the high-pressure side and low-pressure side are installed on both sides of the printhead 30, ink flows in the common supply fluid channel 211 and common collection fluid channel 212 extending in the longitudinal direction of the printhead 30 face each other. This facilitates a heat exchange between the common supply fluid channel 211 and the common collection fluid channel 212, reducing a temperature difference in two common fluid channels. As a result, there is an advantage that a temperature difference hardly occurs in the plurality of element substrates 10 provided along these common fluid channels, and print unevenness owing to the temperature difference hardly occurs.

Note that a support member (to be described later) and the cover member 130 are also heated in the same manner by thermal conduction from the heated element substrates 10. This makes it possible to perform temperature control on a surface facing the transfer member of the printhead 30 by temperature control of the element substrates 10 in the same manner.

Also in a case of an arrangement that circulates a liquid such as ink between a tank and a printhead, it becomes possible to perform temperature control on the surface facing the transfer member of the printhead 30 by heating an element substrate itself with sub heaters (to be described later). A material of low heat conductivity such as a resin is more preferably used for the support member so as not to release heat of the element substrates.

Fluid channel members of the liquid discharge unit 300 will be described next in detail.

The fluid channel member 210 is obtained by laminating a first fluid channel member 50 and a second fluid channel member 60 as shown in FIG. 13, and distributes the ink supplied from the liquid supply units 220 to respective discharge modules 200. The fluid channel member 210 functions as a fluid channel member for returning circulating ink from the discharge modules 200 to the liquid supply units 220. The second fluid channel member 60 of the fluid channel member 210 is a fluid channel member where the common supply fluid channel 211 and the common collection fluid channel 212 are formed inside, and has a function of mainly ensuring the rigidity of the printhead 30. Accordingly, a material having a sufficient corrosion resistance with respect to a liquid and a high mechanical strength is preferred as a material for the second fluid channel member 60. More specifically, SUS, Ti, alumina, or the like, can be used preferably.

Figure 14:
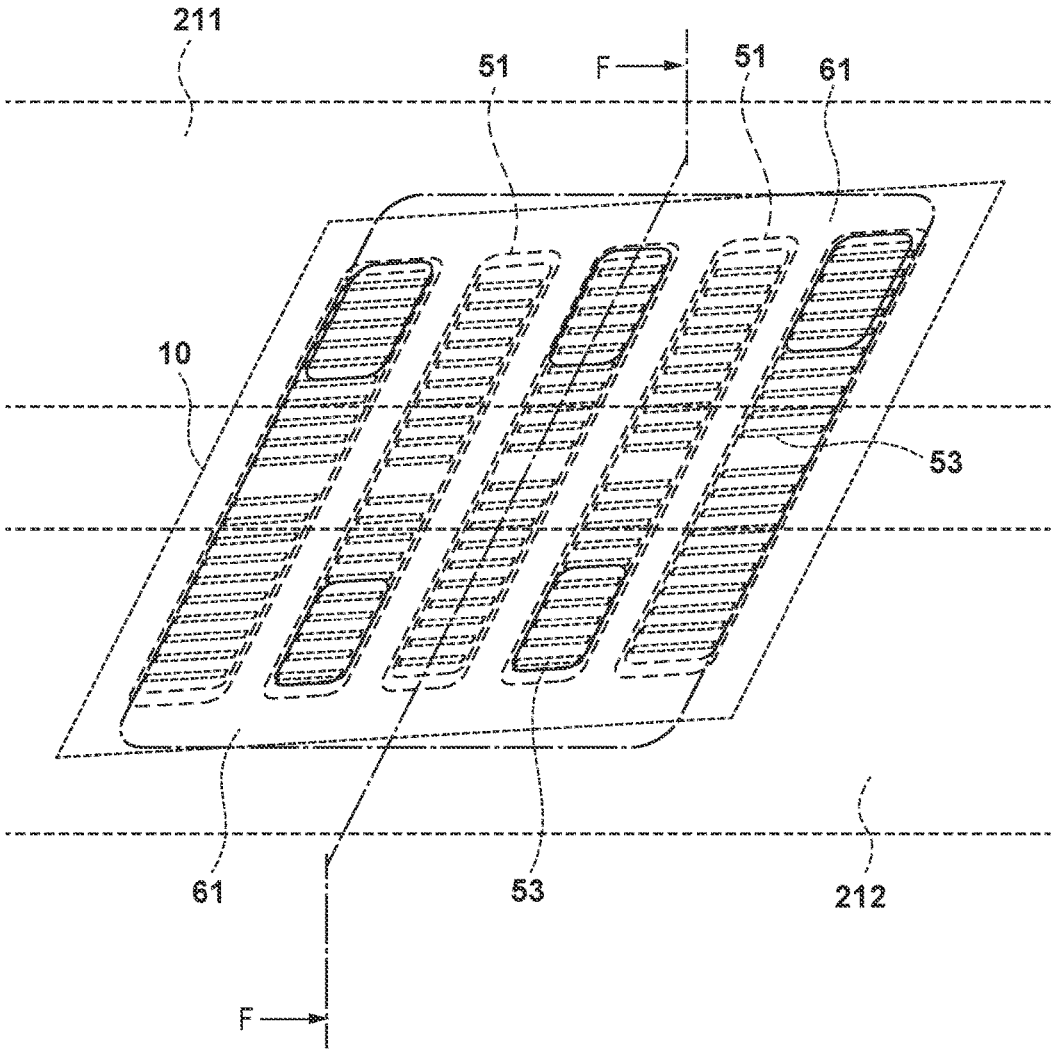
FIG. 14 is a perspective view showing a connection relationship between the element substrates and the fluid channel member.

FIG. 14 is a perspective view showing a connection relationship between the element substrates 10 and the fluid channel member 210.

As shown in FIG. 14, a pair of common supply fluid channel 211 and common collection fluid channel 212 extending in the longitudinal direction of the printhead 30 are provided in the fluid channel member 210. Communication ports 61 of the second fluid channel member 60 are, respectively, aligned with and connected to individual communication ports 53 of the first fluid channel member 50. A liquid supply channel communicating from the communication ports 61 of the second fluid channel member 60 to a communication port 51 of the first fluid channel member 50 via the common supply fluid channel 211 is formed. Similarly, a liquid supply channel communicating from the communication ports 61 of the second fluid channel member 60 to the communication port 51 of the first fluid channel member 50 via the common collection fluid channel 212 is also formed.

Figure 15:
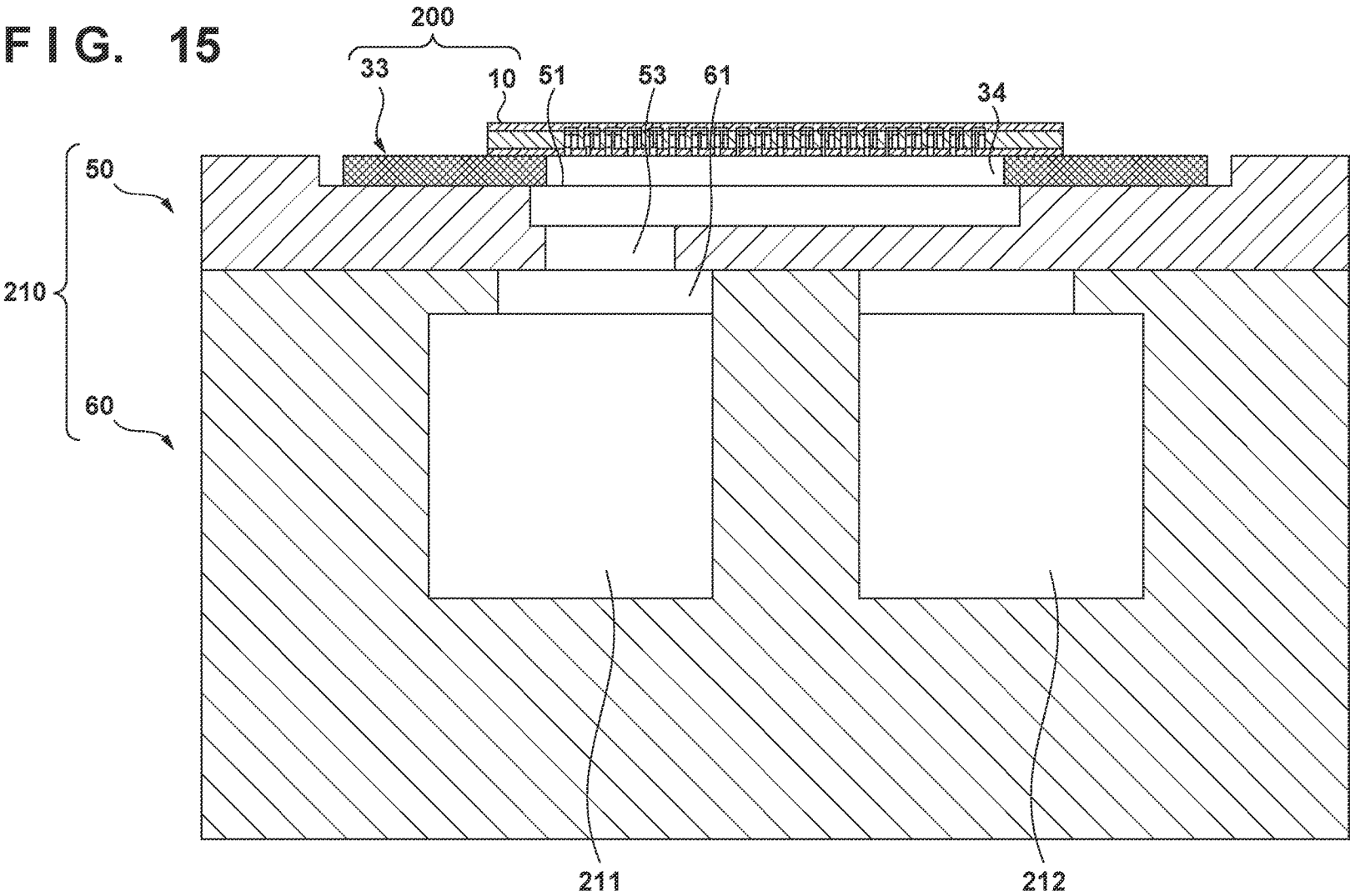
FIG. 15 is a view showing a section taken along a line F-F in FIG. 14.

FIG. 15 is a view showing a section taken along a line F-F in FIG. 14. As shown in FIG. 15, the common supply fluid channel 211 is connected to the discharge module 200 via the communication port 61, the individual communication port 53, and the communication port 51. Referring to FIG. 14, it is obvious that the individual collection fluid channel is connected to the discharge module 200 by the same channel in another section. In each discharge module 200 and element substrate 10, a fluid channel communicating with respective orifices via a liquid supply port 34 is formed, allowing supplied ink to partially or wholly pass through an orifice (pressure chamber) where a discharge operation is ceased and circulate.

Note that a support member 33 supports the element substrate 10 and is connected to the first fluid channel member 50.

(3) Description of Structure of Element Substrate

FIGS. 16A to 16C are views each showing the structure of the element substrate.

FIG. 16A is a schematic view showing a surface on a side where orifices 13 and terminals 16 of the element substrate 10 are arranged. FIG. 16B is a schematic view showing a back surface where a lid member 20 having a plurality of openings 21 is detached from the element substrate 10. FIG. 16C is a schematic view showing a back surface of the surface shown in FIG. 16A.

As shown in FIG. 16A, the plurality (20 arrays in this example) of orifice arrays are formed on a surface where the orifices 13 of the element substrate 10 are formed. Note that a direction in which the orifice arrays where the plurality of orifices 13 are arrayed extend will be referred to as an "orifice array direction". A heat generating element (electrothermal transducer) for bubbling ink by thermal energy is arranged at a position corresponding to each orifice 13 shown in FIG. 16A. As shown in FIG. 16B, an ink supply channel 18 and an ink collection channel 19 used for ink circulation are provided on both sides of each orifice array. As shown in FIG. 16C, the lid member 20 includes openings 21 communicating with the liquid supply port 34 of the support member 33.

Figure 17:
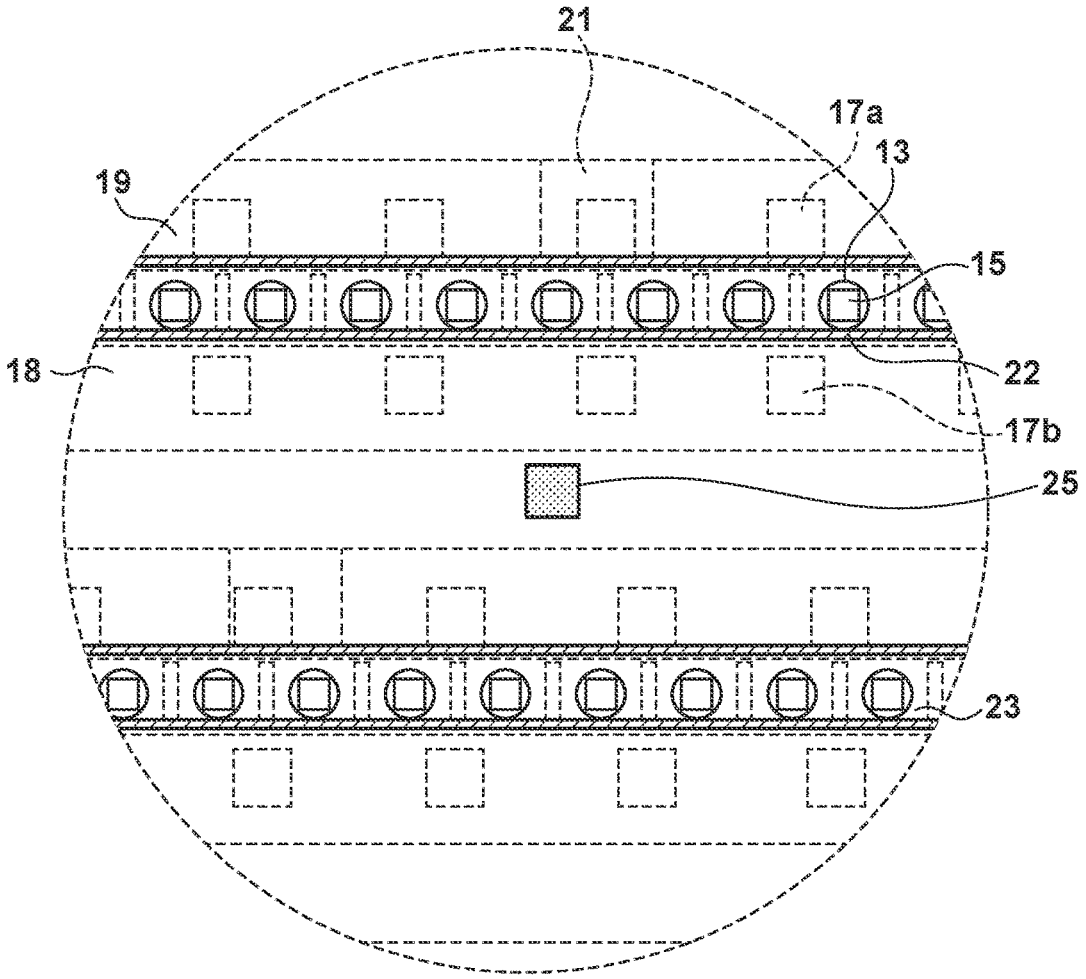
FIG. 17 is an enlarged view of FIG. 16B showing an enlarged part of two orifice arrays.

FIG. 17 is an enlarged view of FIG. 16B showing an enlarged part of two orifice arrays.

Print elements 15 formed by the electrothermal transducers shown in FIG. 17 are electrically connected to the terminals 16 shown in FIG. 16A by an electric wiring (not shown) provided on the element substrate 10. Then, based on a pulse signal input from the printing control unit 15A of the printing system 1 via the electric wiring boards 90 and a flexible wiring substrate (not shown), the print elements 15 generate heat to boil ink. The ink is discharged from the orifices 13 with a bubbling force by this boiling. The ink supply channels 18 and the ink collection channels 19 are provided alternately along the orifice array direction on the back surface of the element substrate 10. The ink supply channels 18 and the ink collection channels 19 are fluid channels provided on the element substrate 10 and extending in the orifice array direction, and communicate with the orifices 13 via supply ports 17*a* and collection ports 17*b*, respectively. Furthermore, pressure chambers 23 that include the print elements 15 inside are partitioned by partitions 22.

On the element substrate 10, as shown in FIG. 17, a temperature sensor 25 that measures the temperature of the element substrate is provided between two orifice arrays. Furthermore, not only the print elements 15 but also sub heaters (to be described later) are provided inside the respective orifices 13 for the temperature control of the printhead.

Figure 18A:
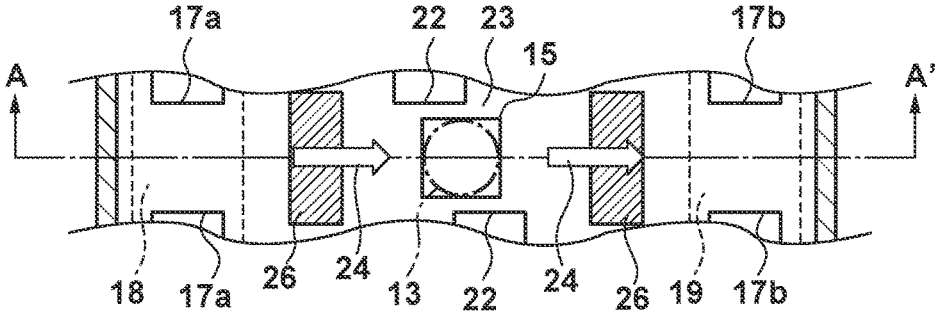
FIGS. 18A, 18B and 18C are views each for explaining the structure of an orifice and an ink fluid channel in a vicinity thereof of the printhead.
Figure 18B:
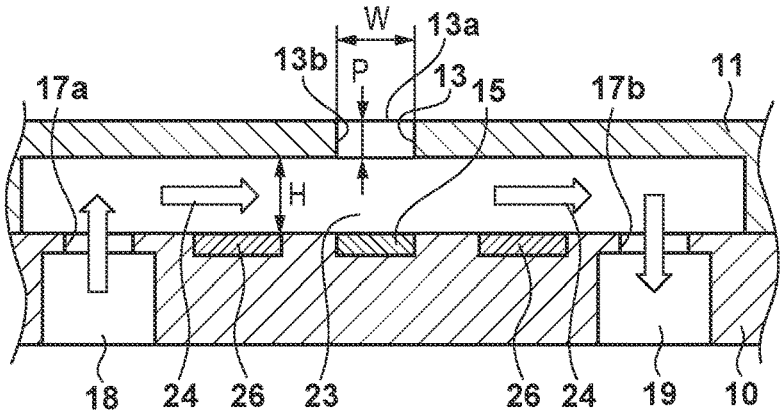
Figure 18C:
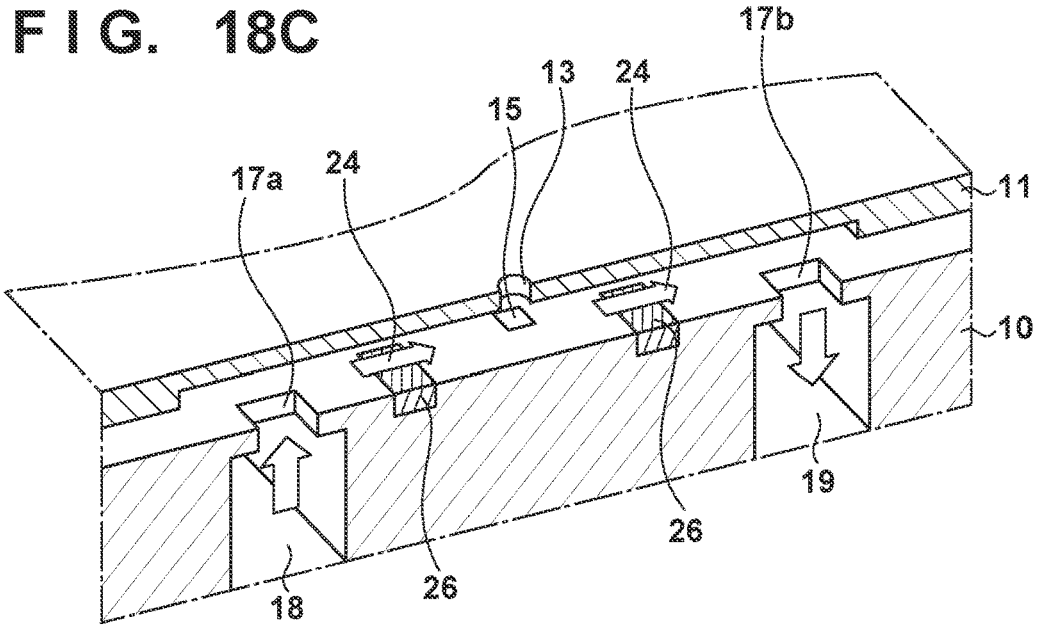

FIGS. 18A to 18C are views each for explaining the structure of an orifice and an ink fluid channel in a vicinity thereof of the printhead.

FIG. 18A is a plan view showing the ink fluid channel and the like viewed from an ink discharge surface. FIG. 18B is a sectional view taken along a line A-A' in FIG. 18A. FIG. 18C is a perspective view showing a section taken along the line A-A' in FIG. 18A.

As shown in these views, by the ink circulation that has been described with reference to FIG. 13 and the like, an ink flow occurs in the pressure chamber 23 where the print element 15 on the element substrate 10 of the printhead is provided, and in fluid channels 24 in front of and behind the pressure chamber 23. That is, by a pressure difference that generates the ink circulation, ink supplied from the ink supply channel 18 via the supply ports 17*a* provided on the element substrate 10 generates a flow passing through the fluid channel 24, the pressure chamber 23, and the fluid channel 24 and reaching the ink collection channel 19 via the collection ports 17*b*. Note that the pressure chamber 23 and the fluid channels 24 are formed by covering the element substrate 10 with an upper lid 11.

Along with the above-described ink flow, at the time of ink non-discharge, a space from the print element 15 to the orifice 13 above is filled with ink, and an ink meniscus (ink interface 13*a*) is formed in the vicinity of an end portion of the orifice 13 having a diameter W on the side of the discharge direction. Note that this ink interface is represented by a straight line (plane) in FIG. 18B, but its shape is decided in accordance with a member that forms a wall (thickness P) of the orifice 13 and an ink surface tension, and generally becomes a concave or convex curve (curved surface). The ink interface is represented by the straight line here for the sake of descriptive simplicity.

By driving the electrothermal transducer (heater) that forms the print element 15 in a state in which this meniscus is formed, a bubble is formed in ink by using generated heat, and the ink is discharged from the orifice 13. Note that here, the flow rate of the ink flowing through the fluid channels 24 is, for example, about 0.1 to 100 mm/s, making it possible to make an influence on landing accuracy or the like comparatively small even if a discharge operation is performed in a state in which the ink flows.

The temperature of the printhead decreases easily because heat generated upon the discharge operation or heat from an external environment in the vicinity of the orifice 13 is exhausted to supply new ink by circulating ink in a fluid channel between the orifice 13 and print element 15 of the printhead. To cope with this, in this embodiment, sub heaters 26 are provided on both sides of the print element 15, and the element substrate 10 is warmed up by energizing these sub heaters, making it possible to control the temperature of the printhead 30.

In particular, by controlling the temperature of the printhead to a temperature equal to or higher than a target temperature obtained from a transfer body temperature or humidity measured by the humidity sensors 115, it becomes possible to obtain a satisfactory image without causing dew condensation in the printhead.

(4) Temperature Control Processing of Printhead

Figure 19:
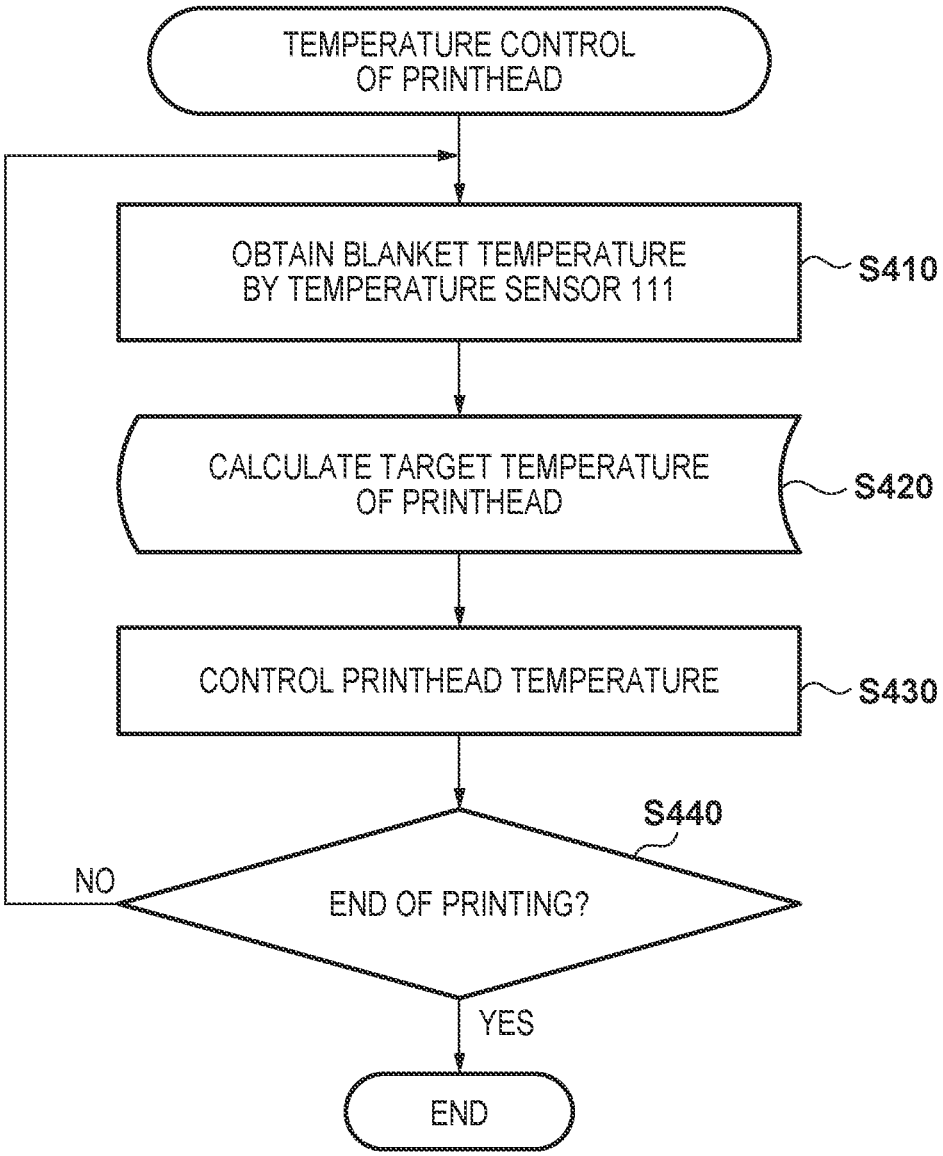
FIG. 19 is a flowchart showing temperature control of a printhead based on a temperature of a transfer member measured by a temperature sensor.

FIG. 19 is a flowchart showing temperature control of a printhead based on a temperature of a transfer member measured by a temperature sensor.

According to FIG. 19, in step S410 during a printing operation, the temperature sensor 111 measures and obtains a temperature (TTB) of the transfer member 2 on the immediate downstream side of the application unit 5A with respect to the rotation direction of the transfer member 2.

In step S420, based on the measured temperature, a target temperature (TT) of each printhead 30 is calculated so that the temperature of the printhead 30 becomes higher than that of the transfer member 2. It is desirable that the target temperature is about equal to an environmental temperature at which the printing system 1 is installed.

Furthermore, in step S430, the calculated target temperature (TT) of the printhead and a temperature (HT) of a current printhead measured by the temperature sensor 25 are compared. If HT<TT (the temperature of the printhead is lower than the target temperature) holds, the printhead 30 is warmed up by energizing the sub heaters 26, and control is performed such that the temperature (HT) of the printhead becomes the calculated target temperature. In contrast to this, if HT≥TT (the temperature of the printhead is higher than the target temperature) holds, warming up by the sub heaters 26 is not performed.

Then, in step S440, it is checked whether the temperature of the printhead becomes the above-described target temperature. Here, if such a temperature is obtained, it is determined that the printing operation can be continued, and the process returns to step S410. If the temperature of the printhead falls outside the temperature range, the printing operation is stopped.

Therefore, according to the above-described embodiment, the temperature of the printhead is controlled so as to be higher than the temperature of the transfer member, making it possible to maintain the temperature of the printhead in a proper range.

Note that in the temperature control of the printhead shown in FIG. 19, the sub heaters and temperature sensor of the printhead are used. It is further possible, however, to reflect measurement results of humidity sensors provided inside the print unit and in the vicinities of the printheads on the temperature control of the printheads.

Figure 20:
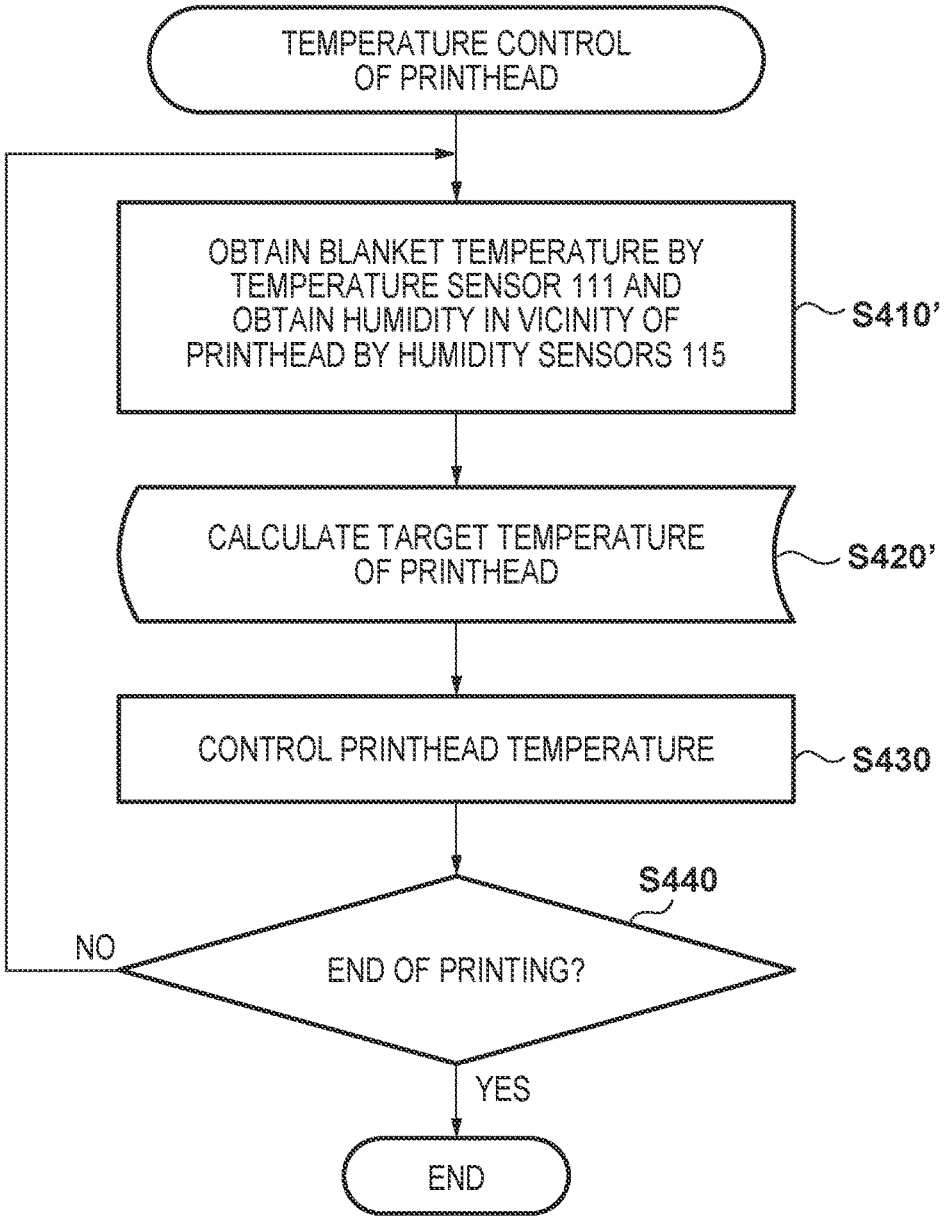
FIG. 20 is a flowchart showing temperature control of the printhead based on the temperature of the transfer member and the temperature of the printhead measured by the temperature sensor, and humidity in the vicinity of the printhead measured by the humidity sensors.

FIG. 20 is a flowchart showing temperature control of the printhead based on the temperature of the transfer member and the temperature of the printhead measured by the temperature sensor, and humidity in the vicinity of the printhead measured by the humidity sensors. Note that in FIG. 20, the same processing steps as already described with reference to FIG. 19 are denoted by the same step reference numbers, and a description thereof will be omitted.

According to FIG. 20, in step S410' during a printing operation, the temperature sensor 111 measures and obtains the temperature (TTB) of the transfer member 2 on the immediate downstream side of the application unit 5A with respect to the rotation direction of the transfer member 2. In addition, the humidity sensors 115 provided between the printheads 30 and in the vicinities of the printheads 30 shown in FIG. 8 measure humidity in the vicinities of the printheads.

It is preferable to detect, as this humidity, humidity, in a location where a larger amount of ink is accumulated on the transfer member 2, which is obtained by the humidity sensor 115 arranged on the most downstream side of the printheads 30 and outside the print unit 3. At this position, inks of all colors are accumulated on the transfer member 2, obtaining the largest amount of ink on the transfer member 2. Therefore, this location is considered to have the largest evaporation amount of a liquid component from ink and the highest humidity according to the temperature of the transfer member 2. However, humidity measurement is not limited to this. Humidity obtained by other humidity sensors provided inside the print unit 3 may be used, or humidity obtained by averaging or weighted averaging measurement results from these plurality of humidity sensors may be used.

In step S420', based on the measured temperature (TTB) and measured humidity (H), a dew-point temperature (DT) in the vicinity of each printhead is calculated, and the target temperature (TT) of the printhead is calculated such that the temperature (HT) of the printhead becomes higher than the dew-point temperature (DT).

Steps S430 and S440 are performed below as described in FIG. 19.

Therefore, according to a process based on FIG. 20, the temperature of the printhead is controlled so as to be higher than the dew-point temperature obtained based on the temperature and humidity measured by the temperature sensor and humidity sensors, making it possible to maintain the temperature of the printhead in a proper range without dew condensation occurring.

Another Embodiment

As an arrangement that removes highly humid air in the vicinity of printheads so as not to cause dew condensation in the printheads, an arrangement that removes the highly most air directly in addition to performing temperature control of the printheads based on a dew-point temperature calculated from measurement by humidity sensors and a temperature sensor may be used.

Figure 21:
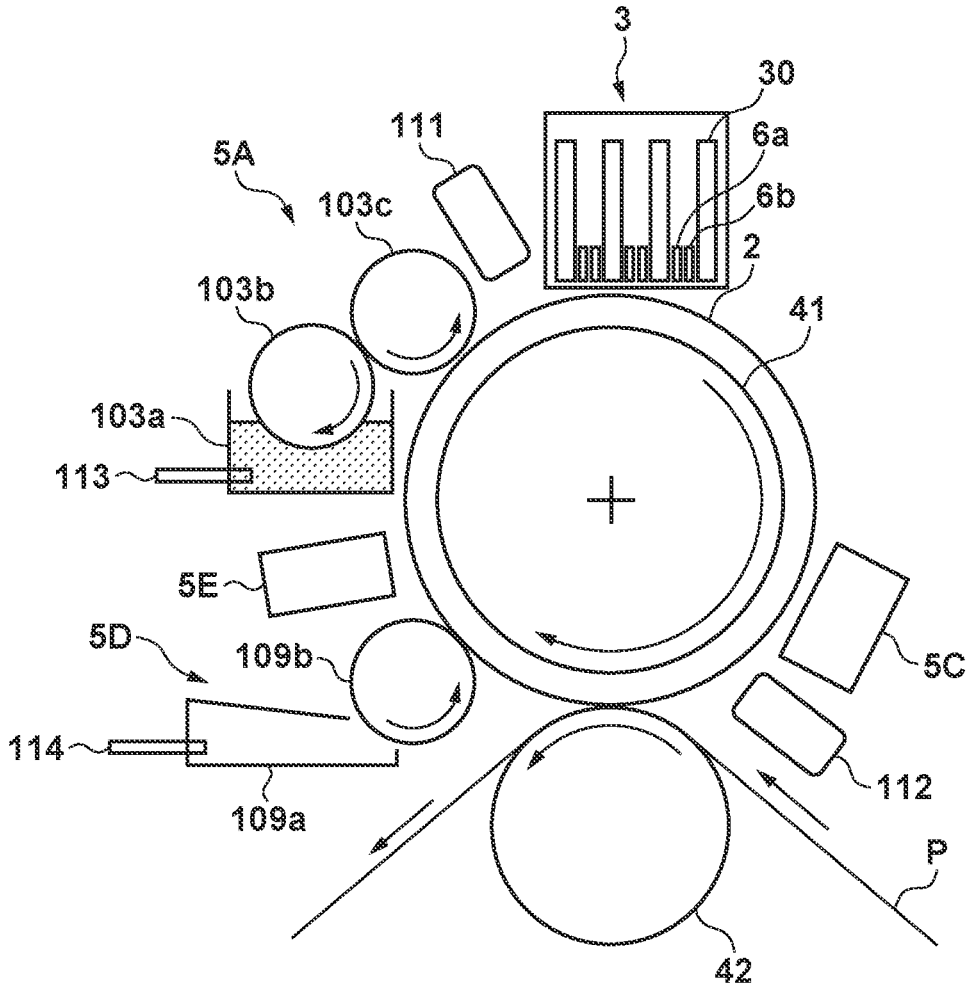
FIG. 21 is a view schematically showing constituent elements provided around a transfer member in order to perform the temperature control of the printheads.

FIG. 21 is a view schematically showing constituent elements provided around a transfer member in order to perform the temperature control of the printheads. Note that in FIG. 21, the same reference numerals denote the same constituent elements shown in FIG. 8 that have already been described, and a description thereof will be omitted.

As shown in FIG. 21, suction ducts 6*a* and blowing ducts 6*b* are provided between a plurality of printheads 30 of a print unit 3. Then, while the suction ducts 6*a* suck highly humid air between the printheads 30 and a transfer member 2, the blowing ducts 6*b* blow dry air between the printheads 30 and the transfer member 2. This makes it possible to prevent the highly humid air from flowing into the printheads on a downstream side with respect to a rotation direction of the transfer member 2, and decrease humidity between the printheads 30 and the transfer member 2.

Therefore, the dew-point temperature is also decreased due to a drop in humidity of air in the vicinities of the printheads by the suction ducts and blowing ducts provided between the printheads. As a result, it is possible to prevent dew condensation.

Note that in addition to this, as described in the aforementioned embodiment, it is preferable that a temperature sensor 111 measures a temperature (TTB) of the transfer member 2 and based on the measured temperature, the temperature control of the printheads 30 is performed such that the temperature of each printhead 30 becomes higher than that of the transfer member 2.

Still Another Embodiment

In the above embodiment, the print unit 3 includes the plurality of printheads 30. However, a form may include only one printhead 30. The printhead 30 need not be a full-line head but may be of a serial type that forms an ink image by discharging ink from the printhead 30 while moving the printhead 30 in the Y direction.

A conveyance mechanism of the print medium P may adopt another method such as a method of clipping and conveying the print medium P by the pair of rollers. In the method of conveying the print medium P by the pair of rollers or the like, a roll sheet may be used as the print medium P, and a printed product P' may be formed by cutting the roll sheet after transfer.

In the above embodiment, the transfer member 2 is provided on the outer peripheral surface of the transfer drum 41. However, another method such as a method of forming a transfer member 2 into an endless swath and running it cyclically may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-133058, filed Jul. 6, 2017, which is hereby incorporated by reference herein in its entirety.

What is claimed is:

1. An inkjet printing apparatus comprising:

a transfer member;

a printhead configured to discharge ink to form an image on the transfer member;

a transfer unit configured to transfer the image on the transfer member to a print medium;

a heating unit configured to heat the transfer member;

a first measurement unit configured to measure a temperature of the transfer member heated by the heating unit; and an adjustment unit configured to adjust a temperature of the printhead based on a temperature measured by the first measurement unit.

2. The apparatus according to claim 1, wherein the transfer member is a rotating body that rotates about a predetermined rotation axis, and a surface of the transfer member is configured to move cyclically on a circular orbit by the rotation, and the first measurement unit is arranged on an upstream side, with respect to a rotation direction of the rotating body, of a position at which an image is formed by discharging ink to the transfer member by the printhead.

3. The apparatus according to claim 2, wherein the adjustment unit includes:

a warm-up unit provided inside the printhead and configured to warm up the printhead; and a second measurement unit provided inside the printhead and configured to measure a temperature of the printhead, and the warm-up unit is driven to adjust the temperature of the printhead.

4. The apparatus according to claim 3, wherein the adjustment unit adjusts the temperature of the printhead to be higher than the temperature of the transfer member measured by the first measurement unit.

5. The apparatus according to claim 3, further comprising:

a third measurement unit configured to measure humidity in a vicinity of the printhead; and a calculation unit configured to calculate a dew-point temperature based on the temperature of the transfer member measured by the first measurement unit and the humidity measured by the third measurement unit, wherein the adjustment unit adjusts the temperature of the printhead to be higher than the dew-point temperature calculated by the calculation unit.

6. The apparatus according to claim 5, wherein the printhead comprises a plurality of printheads in the rotation direction of the rotating body, and the third measurement unit is provided in at least one of a position on a downstream side of a position at which the image is formed and a position between printheads, of the plurality of printheads.

7. The apparatus according to claim 2, further comprising a cooling unit configured to cool the transfer member after the image is transferred by the transfer unit, wherein the heating unit is arranged on an upstream side, with respect to the rotation direction of the rotating body, of a position at which the image is transferred by the transfer unit, and the cooling unit is arranged on a downstream side, with respect to the rotation direction of the rotating body, of the position at which the image is transferred by the transfer unit.

8. The apparatus according to claim 1, further comprising:

a blowing unit configured to blow air to a space between the printhead and the transfer member; and a suction unit configured to suck the air from the space.

9. The apparatus according to claim 1, further comprising an ink tank configured to supply ink to the printhead, wherein the printhead is configured to circulate the ink with the ink tank.

10. The apparatus according to claim 9, wherein the printhead includes a plurality of nozzles configured to discharge the ink, and the ink circulates in each of the plurality of nozzles.

11. A temperature control method in an inkjet printing apparatus that includes a transfer member, a printhead configured to discharge ink to form an image on the transfer member, and a transfer unit configured to transfer the image on the transfer member to a print medium, the method comprising:

heating the transfer member by a heater;

measuring a temperature of the heated transfer member; and adjusting a temperature of the printhead based on the measured temperature.

12. The method according to claim 11, wherein the transfer member is a rotating body that rotates about a predetermined rotation axis, and a surface of the transfer member is configured to move cyclically on a circular orbit by the rotation, and measurement of the temperature of the heated transfer member is performed on an upstream side, with respect to a rotation direction of the rotating body, of a position at which an image is formed by discharging ink to the transfer member by the printhead.

13. The method according to claim 12, wherein in the adjusting, the printhead is warmed up by an internal heater of the printhead, and the temperature of the printhead is measured by an internal sensor of the printhead, and the internal heater is driven to adjust the temperature of the printhead.

14. The method according to claim 13, wherein in the adjusting, the temperature of the printhead is adjusted to be higher than the measured temperature of the transfer member.

15. The method according to claim 13, further comprising:

measuring humidity in a vicinity of the printhead; and calculating a dew-point temperature based on the measured temperature of the transfer member and the measured humidity in the vicinity of the printhead, wherein in the adjusting, the temperature of the printhead is adjusted to be higher than the calculated dew-point temperature.

16. The method according to claim 15, wherein a plurality of the printheads are provided in the rotation direction of the rotating body, and a sensor configured to measure the humidity in the vicinity of the printhead is provided at least one of a position on a downstream side of a position at which the image is formed and a position between printheads, of the plurality of printheads.

17. The method according to claim 12, further comprising cooling the transfer member after the image is transferred by the transfer unit, wherein the heater is arranged on an upstream side, with respect to the rotation direction of the rotating body, of a position at which the image is transferred by the transfer unit, and a chiller for the cooling is arranged on a downstream side, with respect to the rotation direction of the rotating body, of the position at which the image is transferred by the transfer unit.

18. The method according to claim 11, further comprising:

blowing air to a space between the printhead and the transfer member; and sucking the air from the space.

* * * * *